US006383124B1

(12) United States Patent
St. Germain et al.

(10) Patent No.: US 6,383,124 B1
(45) **Date of Patent: *May 7, 2002**

(54) HIGH SPEED PAPER FOLDING MACHINE

(76) Inventors: Patrick C. St. Germain, R.R. #2, Box 100B, Iron River, WI (US) 54847; Vernon C. Wickman, R.R. #1, Box 65, Port Wing, WI (US) 54865

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/345,574

(22) Filed: Jun. 30, 1999

Related U.S. Application Data

(63) Continuation-in-part of application No. 09/045,754, filed on Mar. 20, 1998, now abandoned.

(51) Int. Cl.[7] ..... B31B 1/14

(52) U.S. Cl. ..... 493/353; 493/354; 493/359; 493/424; 493/425; 493/442

(58) Field of Search ..... 493/432, 433, 493/359, 353, 354, 424, 425, 369, 370, 357, 406, 407, 442, 454; 53/116, 117, 120, 429

(56) References Cited

U.S. PATENT DOCUMENTS

| | | | | |
|---|---|---|---|---|
| 2,137,978 A | | 11/1938 | Mills et al. | |
| 2,328,814 A | | 9/1943 | Laukhuff | |
| 2,703,238 A | | 3/1955 | Hand | |
| 3,640,522 A | | 2/1972 | Olemann et al. | |
| 3,758,102 A | | 9/1973 | Munn et al. | |
| 3,870,292 A | | 3/1975 | Bradley | |
| 4,519,597 A | | 5/1985 | DeSanto | |
| 4,790,804 A | | 12/1988 | Gotou et al. | |
| 5,000,729 A | | 3/1991 | Yamauchi | |
| 5,004,451 A | | 4/1991 | Prüm | |
| 5,405,126 A | * | 4/1995 | Mack | 493/424 |
| 5,429,578 A | * | 7/1995 | Calbrix et al. | 493/424 |
| 5,468,209 A | * | 11/1995 | Rohrhiursch et al. | 493/424 |
| 5,846,177 A | * | 12/1998 | Mayr | 493/424 |

* cited by examiner

*Primary Examiner*—Eugene Kim
(74) *Attorney, Agent, or Firm*—Olson & Hierl, Ltd.

(57) ABSTRACT

A high speed paper folding machine for cutting a continuously fed web of paper into sections and folding said sections is disclosed. The machine includes a rotating hollow drum on which the web is deposited and on which the cutting and folding operations are performed without transferring the web or the cut or folded sections off of the drum. The drum includes a knife for cutting the web. The knife preferably is situated within the drum interior and adapted to extend through elongated apertures defined on the drum outer surface. Grippers on the drum hold the web on the drum through the operation. At least one folding station is operably associated with the drum. At least one pack-off station can be provided for stacking the folded product in separate stacks.

29 Claims, 17 Drawing Sheets

HIGH SPEED PAPER FOLDING MACHINE

CROSS-REFERENCE TO RELATED APPLICATION

This application is a continuation-in-part of application U.S. Ser. No. 09/045,754 filed on Mar. 20, 1998 now abandoned.

FIELD OF THE INVENTION

The present invention relates to a paper folding machine for cutting a continuously fed web of paper into sections and folding the sections at a relatively high rate and without transferring the paper web from one roll to another.

BACKGROUND OF THE INVENTION

Paper folding and cutting machines have long been well known in the paper handling art. Generally, these machines have the capability of performing multiple operations on either a continuous web of paper or on multiple separate pieces of paper fed into such machines. For example, a typical paper folding machine may include multiple drums or rolls performing specific functions such as feed rolls, folding rolls, knife rolls, ironing rolls and packer rolls. Typically, a continuous sheet or web of paper is either pulled or fed through a preliminary forming step which may include folding the sheet lengthwise in half. The once-folded web of paper can then be fed through successive rolls within the machine which perform various folding, cutting and packing functions on the web of paper. However, all such machines currently available commercially are relatively slow.

Generally, paper folding machines also have the capability of delivering the folded pieces of paper in a suitably stacked configuration. In some instances, a paper folding and cutting machine may be used in conjunction with another paper handling machine or operation such as a printing press or an envelope stuffing machine.

One type of paper folding machine commonly used can be described as a buckle-type paper folding machine. An example of a buckle-type machine is illustrated in U.S. Pat. No. 4,834,699 to Martin entitled "Buckle Chute Paper Folding Apparatus." In a buckle-type machine, a piece of paper is fed or pulled through two elongated adjacent rollers that direct the leading edge of the piece of paper into a tray or a chute that is of a finite length and which stops the leading edge of the paper at a predetermined distance from the rollers. Once the leading edge hits the end of the chute, the paper is confined as it is buckled by the first pair of rollers which are still advancing the sheet of paper. The buckled portion of the piece of paper is then caught between another pair of rollers positioned next to the first pair of rollers. The second pair of rollers pull the buckled portion through, thereby creating a folded piece of paper. The buckle-type paper folding machine requires the transferring of a piece of paper between multiple sets of rolls which can result in increased frequency of paper jams.

Another example of a paper folding machine is described in U.S. Pat. No. 4,490,132 to Ogura et al. entitled "Paper Folding Machines For Use in Rotary Presses." Ogura discloses a paper folding machine having multiple rolls and other mechanisms for conveying the sheets of paper and for folding and stacking the sheets of paper. Machines such as the one described in Ogura et al. comprise several rolls that perform the cutting, gripping and folding functions separately. The cutting of the continuous web of paper into separate sections is accomplished before the paper enters the portion of the machine where it is folded. Also, Ogura et al. discloses that the piece of paper is transferred from a first roll to a second roll in order to accomplish the folding procedure.

The disadvantage of present paper folding machines is a limitation on the speed of processing the paper due to the multiple rolls and the transferring of the paper from roll to roll. Also, multiple parts create a higher likelihood of malfunctions and paper jams and require increased maintenance and calibration in order to perform properly.

Thus, there continues to be a need for a paper folding machine that minimizes the number of rolls that a piece of paper must be fed over or through and that will increase the speed of the folding and cutting process, which results in increased productivity. The present invention meets these desires.

SUMMARY OF THE INVENTION

A paper folding machine embodying the present invention performs cutting and folding procedures on a continuously fed web of paper efficiently and at a relatively high rate. The web of paper may be folded longitudinally as it fed into the machine. The machine can be configured to fold the paper either once or multiple times as desired. The step whereby a longitudinally pre-folded web that is cut and folded once within the machine is referred to as a ¼ (quarter) fold. The step whereby the ¼-folded piece is folded once more within the machine is referred to as an ⅛ (eighth) fold. Of course, it is not necessary for the web to be longitudinally pre-folded. For simplicity, the terms "¼ fold" and "⅛ fold" are used herein without regard to pre-folding. Also, the finished product, i.e., the folded sections of paper, can be delivered in separate stacks of selectable variable count by alternately engaging and disengaging pack-off stations, if the machine is so equipped.

The paper folding machine of the present invention comprises a relatively large-diameter rotating hollow drum which includes a peripheral ring defining a drum outer surface. The drum includes grippers spaced from one another on the drum outer surface that hold sections of the web on the drum while the cutting and folding operations take place. The grippers can include vacuum sources or mechanical portions to grip the web. A knife for severing the web while the web is situated on the drum outer surface and being held by the grippers is also included in the machine. Also, a folding station is provided at the periphery of the drum for folding the web while on the rotating drum. The folding station includes a folding roll.

In the preferred embodiment described herein, the grippers are spaced such that the web can be gripped by two of the grippers while the web is cut by the knife. The knife is actuated in synchronism with the rotating drum.

The folding roll is adjacent to and para-axial with the drum and includes a retainer for releasably holding a leading edge of the web to be folded back over a trailing portion of the web while the drum rotates and the gripped portion moves past the folding roll, thereby providing a fold in the web. The folding roll is driven in synchronism with the rotating drum but rotated in a direction opposite that of the rotating drum.

The retainer of the folding roll of the preferred embodiment can comprise a vacuum source within the folding roll for drawing air through a port, whereby a suction effect is created for releasably holding the leading edge of the web against the folding roll while the folding roll rotates and the gripped portion of the web moves past the folding roll. Alternatively, or in a subsequent folding station, a folding arm can be included in the folding roll to remove the gripped portion of the section of the web from the drum and to fold the leading edge back over the trailing portion of the section.

A tucker roll can be included in the folding station. The tucker roll includes a tongue that extends radially outwardly from the periphery of the tucker roll for urging a portion of the web toward one of the grippers.

In another embodiment, the peripheral ring can define at least one knife aperture communicating with the interior of the drum. The knife aperture is situated between two adjacent grippers. In this embodiment, the knife can comprise a rotating body within the interior of the drum having two opposing cutting edges, such as blades, which extend at least partially through the knife apertures.

The folding roll that cooperates with the knife to cut the web and that provides the ¼ fold can include an anvil extending radially outwardly from the folding roll for cooperating with the rotating knife to cut the web via a shearing action whereby a portion of the rotating knife protrudes through an aperture of the drum and cooperates through the aperture with the anvil of the folding roll to sever the web.

An alternate embodiment of the paper folding machine of the present invention can include a subsequent folding station which also includes a folding roll and a tucker roll. The subsequent folding station can be provided to perform the ⅛ fold operation. Additional folding stations can be provided to provide even more folds such a 1/16 (sixteenth) fold (or more).

An ironing roll can be provided, if desired, to press against the folded section in order to flatten the fold by creating a crease.

Another optional feature can be a pack-off station for cooperating with the drum to remove the folded sections of the web. The pack-off station can also stack the folded product, and, if desired, can provide separate stacks of folded product.

There are other advantages and features of the present invention which will be more readily apparent from the following detailed description of the preferred embodiment of the invention, the drawings and the appended claims.

DESCRIPTION OF THE PREFERRED EMBODIMENTS

Figure 1:
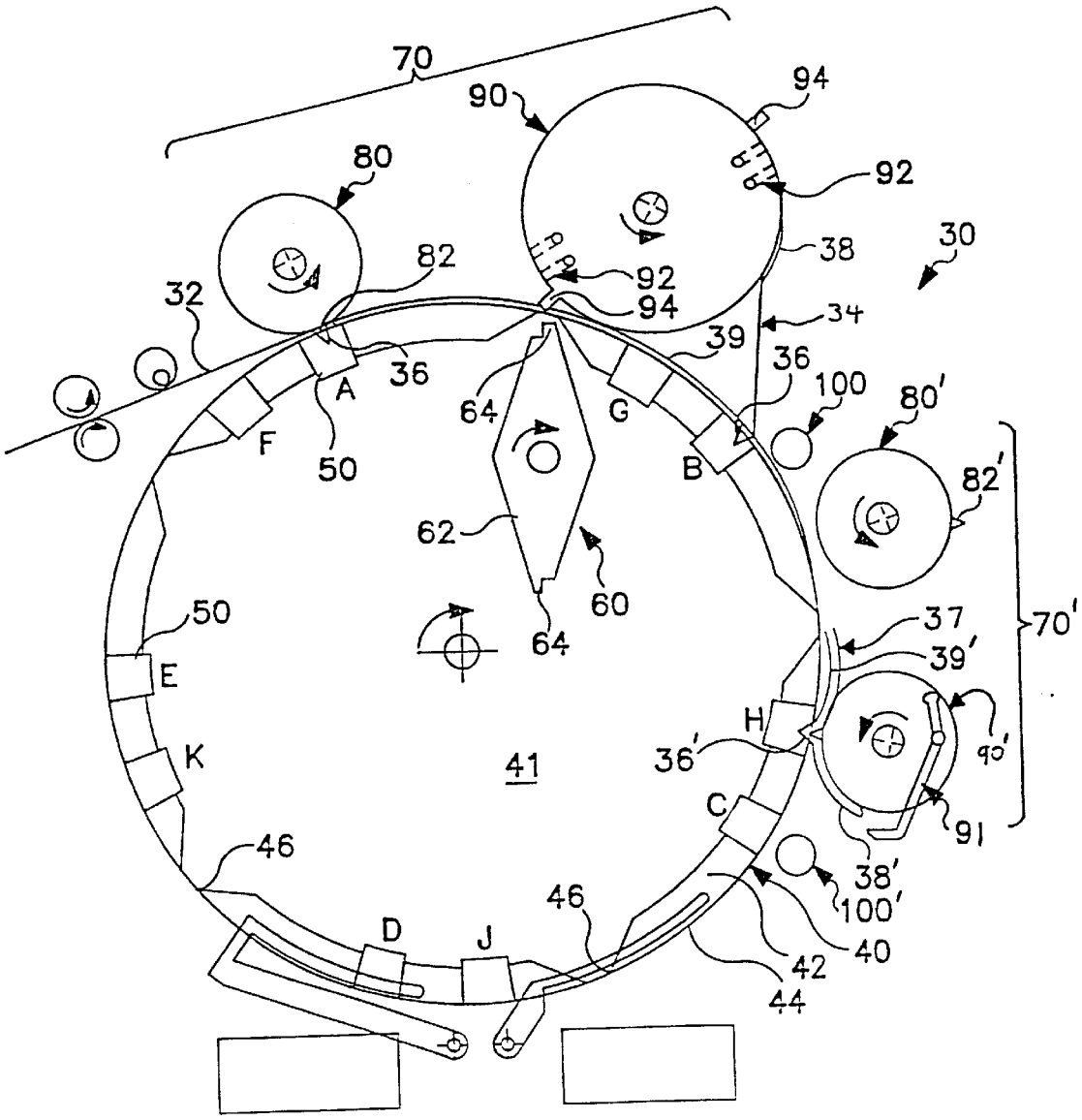
FIG. 1 is a simplified side elevation of a paper folding machine embodying the present invention showing a web of paper at various stages of the cutting and folding process.

The invention disclosed herein is, of course, susceptible of embodiment in many different forms. Shown in the drawings and described hereinbelow in detail are preferred embodiments of the invention. It is to be understood, however, that the present disclosure is an exemplification of the principles of the invention and does not limit the invention to the illustrated embodiments.

For ease of description, a paper folding machine embodying the present invention is described hereinbelow in its usual assembled position as shown in the accompanying drawings and terms such as upper, lower, horizontal, longitudinal, etc., may be used herein with reference to this usual position. However, the paper folding machine may be manufactured, transported, sold, or used in orientations other than that described and shown herein.

Referring to FIGS. 1–11, a high-speed paper folding machine 30 embodying the present invention provides either a ¼ (quarter) folded product or an ⅛ (eighth) folded product from a single machine without necessitating the transfer of paper from one part of the machine to another. Multiple folding operations can be performed while web 32 of paper remains associated with one main drum 40. Web 32 can be continuously fed into the machine to be cut into sections, and the sections can be ¼ folded or ⅛ folded. An additional feature of this preferred embodiment is a mechanism that provides product separation, i.e., the folded sections can be removed from the machine in separate stacks of selectable variable count.

As shown in FIG. 1, a machine 30 embodying the present invention comprises a relatively large-diameter, rotating, hollow drum 40 and at least one folding station 70 where the folding of web 32 is accomplished. Drum 40 can be provided in any diameter suitable for any particular size of folded paper product as desired. Drum 40 includes a peripheral ring 42 having a drum outer surface 44. Ring 42 defines at least one aperture 46 communicating with drum interior 41. Preferably, aperture 46 is elongated, relatively narrow, and defined longitudinally along ring 42. Ring 42 also includes grippers 50 on drum outer surface 44. Grippers 50 are spaced from one another and aperture 46 is situated on ring 42 between adjacent grippers 50.

The embodiment illustrated in FIG. 1 shows ten grippers 50 and five apertures 46. The configuration of FIG. 1 is desirable because it allows web 32 to be gripped by two adjacent grippers 50 while being cut into sections in preparation for folding. For illustrative and reference purposes, locations of grippers 50 are denoted in the FIGS. 1–11 as letters "A" through "K" (omitting "I"). The operation of machine 30 including relative movements of its parts is described in detail below.

Referring again to FIG. 1, a knife 60 is provided for cutting web 32 into sections 34 which are then folded by machine 30 into folded sections 37 or double-folded sections 37'. Knife 60 is situated within drum interior 41, and is preferably a rotating knife; other cutting devices can also be utilized, however. Knife 60 includes a knife body 62 and at least one blade 64. The body 62 is rotatable about an axis that is offset from and parallel to (i.e., para-axial with) the axis of drum 40. In the preferred embodiment, body 62 is generally oblong and knife 60 includes two blades 64 extending radially outwardly from opposite ends of body 62. Knife 60 also can extend longitudinally within the confines of drum 40. Blades 64 are adapted to extend through apertures 46 when one of the blades 64 is aligned with one of the apertures 46.

The embodiment shown in FIGS. 1–11 provides five apertures 46 evenly spaced on drum 40 and two blades on body 62 of knife 60. This configuration allows the relative speeds of rotation of knife 60 and drum 40 to be synchronized such that each aperture 46 advances one-fifth the circumference of drum 40 in the same amount of time that knife 60 makes a half-rotation. In an alternate embodiment, knife 60 can reciprocate rather than rotate. In another alternate embodiment, knife 60 can include more than two blades.

Figure 12:
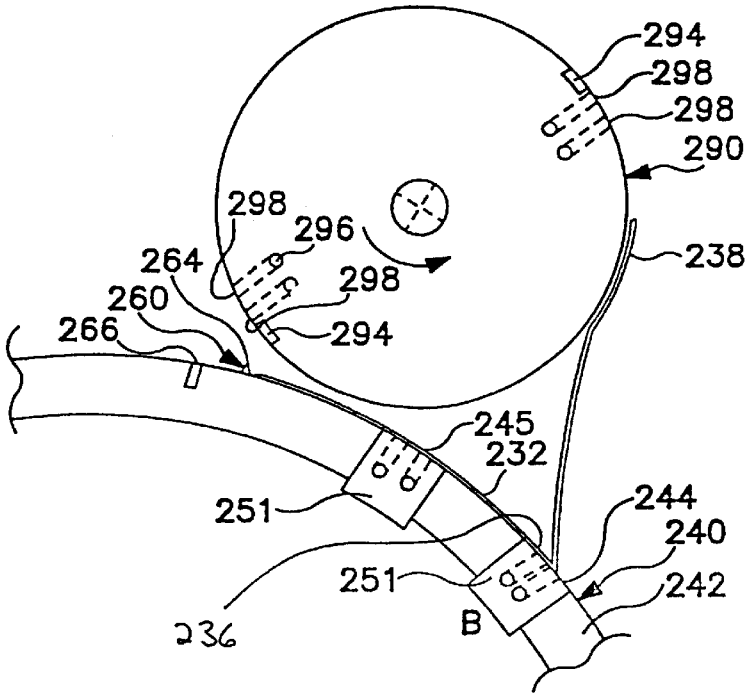
FIG. 12 is an enlarged partial simplified side elevation of the drum and folding station showing an alternate embodiment of the knife, anvil, and grippers.

In yet another alternate embodiment shown in FIG. 12, the apertures 46 and knife 60 can be replaced by multiple knives 260 mounted directly on a peripheral ring 242. Blades 264 cooperate with anvil 294 to sever web 232 into sections 34. Anvil 294 is situated on folding roll 290. Folding roll 270 can include multiple anvils 294, if desired.

Figure 13:
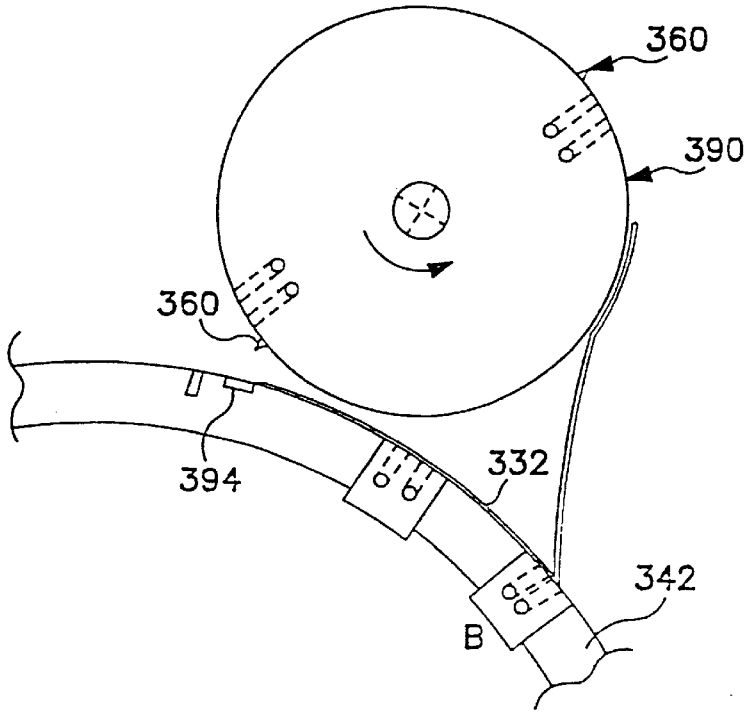
FIG. 13 is an enlarged partial simplified side elevation of the drum and folding station showing yet another alternate embodiment of the knife and anvil.

FIG. 13 shows still another alternate embodiment wherein knife 360 is situated on folding roll 390. Peripheral ring 342 includes anvil 394 which cooperates with knife 360 to sever web 332. As in previously described embodiments, folding roll 390 can include multiple knives 360, and peripheral ring 342 can include multiple anvils 394.

Referring again to FIGS. 1–11, machine 30 also comprises at least one folding station 70 for folding sections 34. Folding station 70 includes a tucker roll 80 and a folding roll 90. The tucker roll 80 and folding roll 90 are preferably adjacent to drum outer surface 44 and substantially para-axial with drum 40. Tucker roll 80 and folding roll 90 are provided to accomplish the folding by cooperating with grippers 50 on drum 40.

As illustrated in FIG. 1, as web 32 is fed into machine 30, an initial folding operation is performed on web 32 by folding station 70 that is closest to the point of entry of web 32 into machine 30. The initial folding station 70 can also cut web 32 to provide a section 34 which is then folded (providing the ¼ fold) to create folded section 37. The cutting and folding operations are performed without transferring web 32 or section 34 from drum 40, as described in more detail below. A subsequent folding station 70' can be utilized (providing the ⅛ fold) to create double-folded section 37'. The subsequent folding station 70', if provided, also includes a tucker roll 80' and a folding roll 90'. The subsequent folding station 70' may be disengageable, if desired, when not needed.

Figure 2:
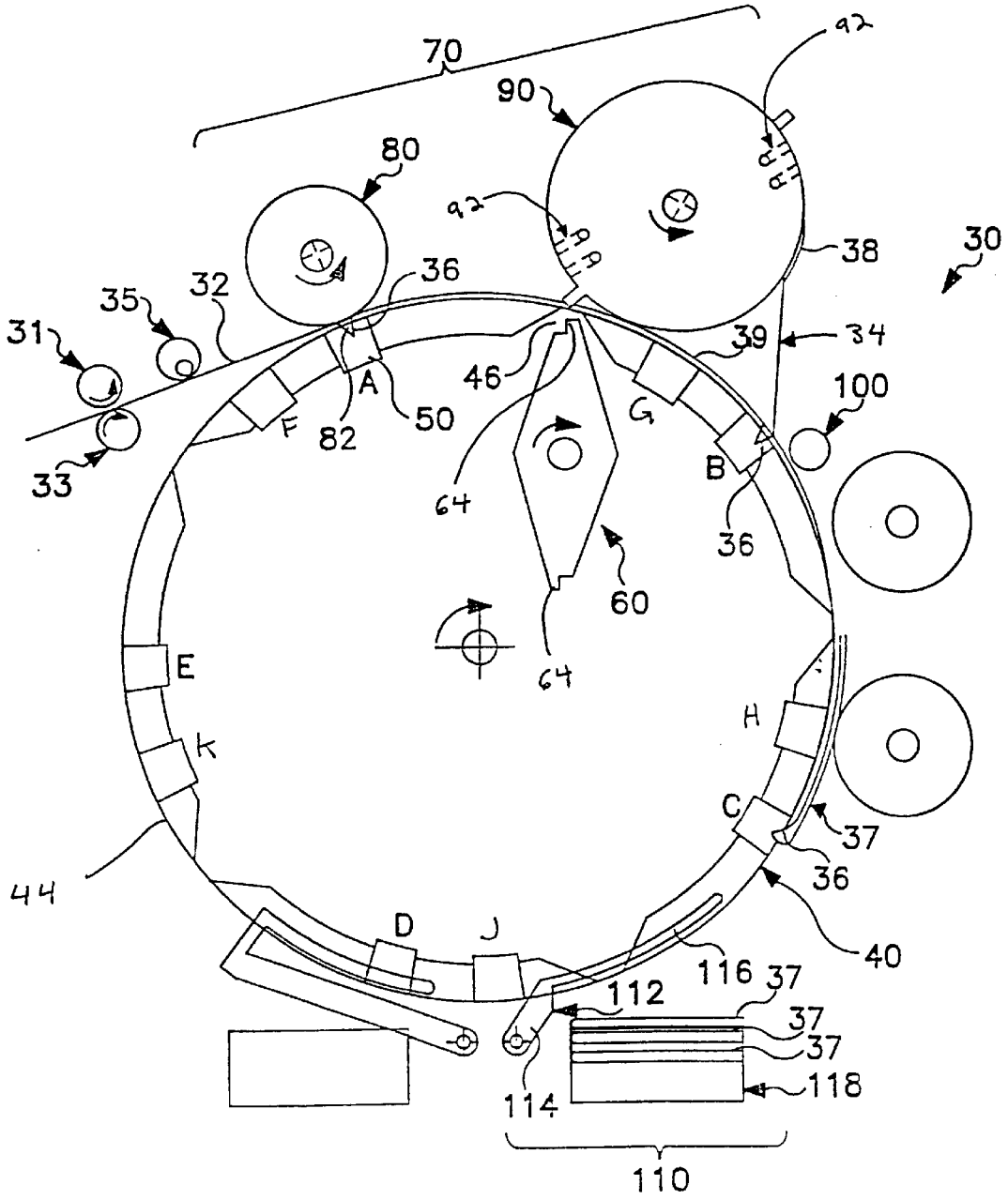
FIG. 2 is a simplified side elevation of the paper folding machine showing the web in relation to the drum and the folding station at a selected moment.

Referring to FIGS. 1 & 2, tucker roll 80 is the first component of folding station 70 to perform an operation on web 32 which is fed between tucker roll 80 and drum 40. Tucker roll 80 includes a tongue 82 that extends radially outwardly from the periphery of tucker roll 80. Tongue 82 also preferably extends longitudinally along tucker roll 80. Tongue 82 urges a portion 36 of web 32 into one of the grippers 50.

In FIGS. 1 & 2, the rotation of tucker roll 80 is synchronized with drum 40 such that every other gripper 50 of the embodiment shown in FIG. 1 advances one-fifth the circumference of drum 40 in the same amount of time that tucker roll 80 makes one rotation. Alternatively, the number of grippers 50 can be varied, in which case, the rotation of drum 40 is adjusted so that for each rotation of tucker roll 80, drum 40 rotates an amount necessary to advance the next gripper 50 into alignment with tongue 82. Also, tucker roll 80 can include multiple tongues; in which case, the diameter and rotation of tucker roll 80 are synchronized appropriately with drum 40.

Figure 14:
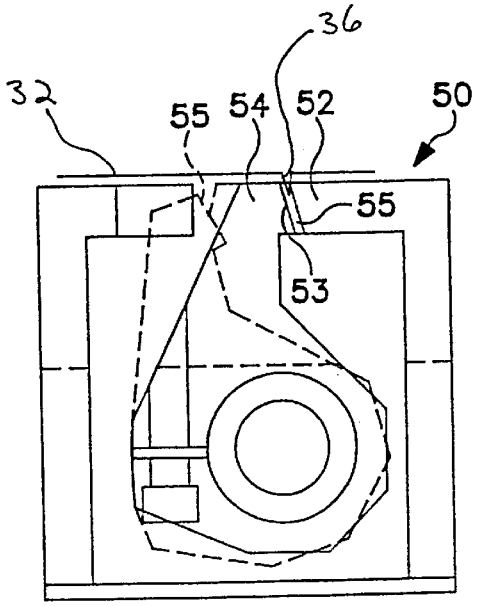
FIG. 14 is a side plan view of a gripper showing movable and fixed portions of the gripper and showing the movable portion in an alternate position.
Figure 15:
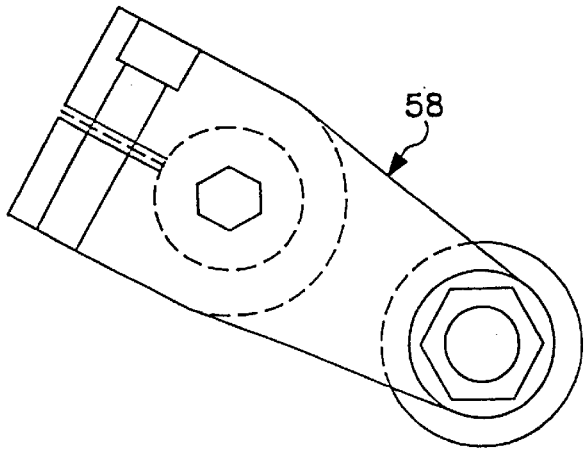
FIG. 15 is a side plan view of a cam follower associated with the movable portion of the gripper of FIG. 14.
Figure 16:
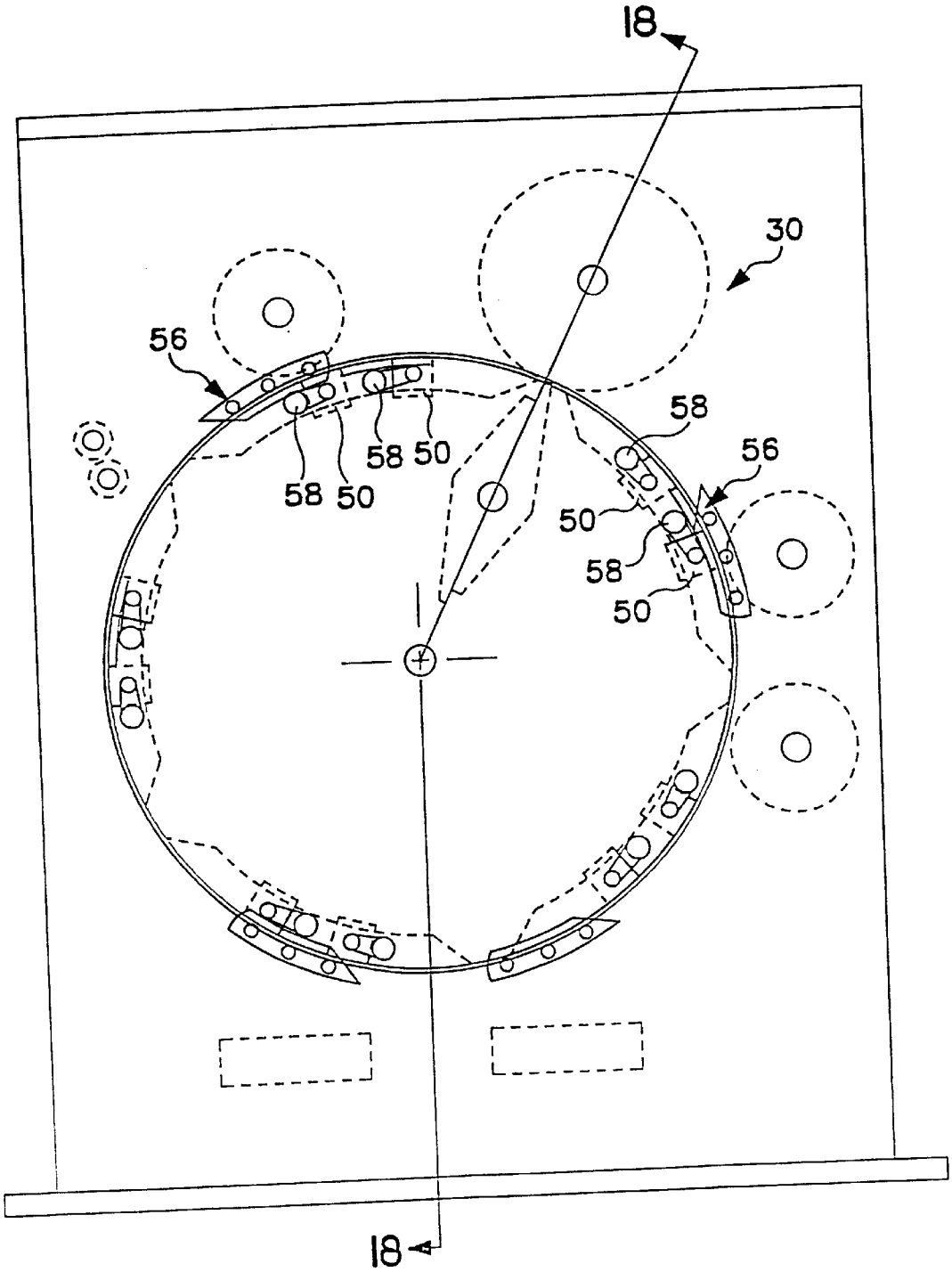
FIG. 16 is a simplified side elevation of the paper folding machine showing gripper cam and follower mechanisms.

After examining FIGS. 14–16, one will note that each gripper 50 is operably associated with a mechanical cam 56 and follower assembly 58 that opens gripper 50 when tongue 82 is aligned with gripper 50 and portion 36 of web 32 is urged into gripper 50 by tongue 82. At the position that tongue 82 starts to retract from gripper 50, the mechanical cam 56 and follower assembly 58 closes gripper 50 causing portion 36 of web 32 to be gripped tightly.

Figure 10:
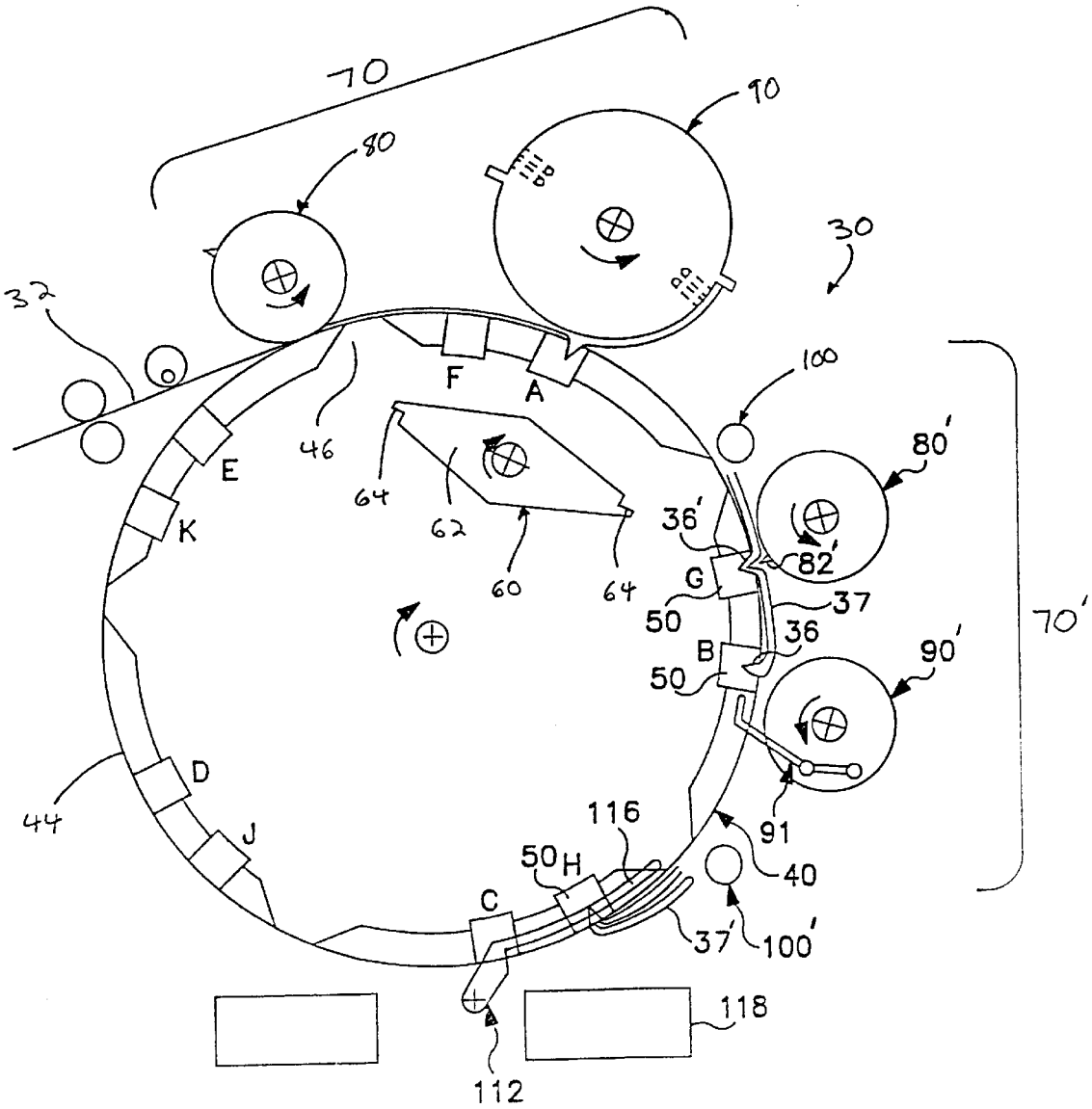
FIG. 10 is a simplified side elevation of the paper folding machine showing the web in relation to the drum and the folding station at a selected moment.

Grippers 50 of the preferred embodiment are illustrated in FIG. 14. Each gripper 50 includes a fixed portion 52 cooperating with a movable portion 54 to grip portion 36 of web 32 after portion 36 is urged into gripper 50 by tongue 82 of roller 80 (FIG. 1) or tongue 82' of roller 80' (FIG. 10). Fixed portion 52 includes an elongated fixed face 53 extending longitudinally along drum 40 (not shown). Movable portion 54 includes an elongated movable face 55 that is normally biased against fixed face 53. Biasing of movable face 55 can be accomplished by a torsion bar cooperating with movable portion 54.

Figure 17:
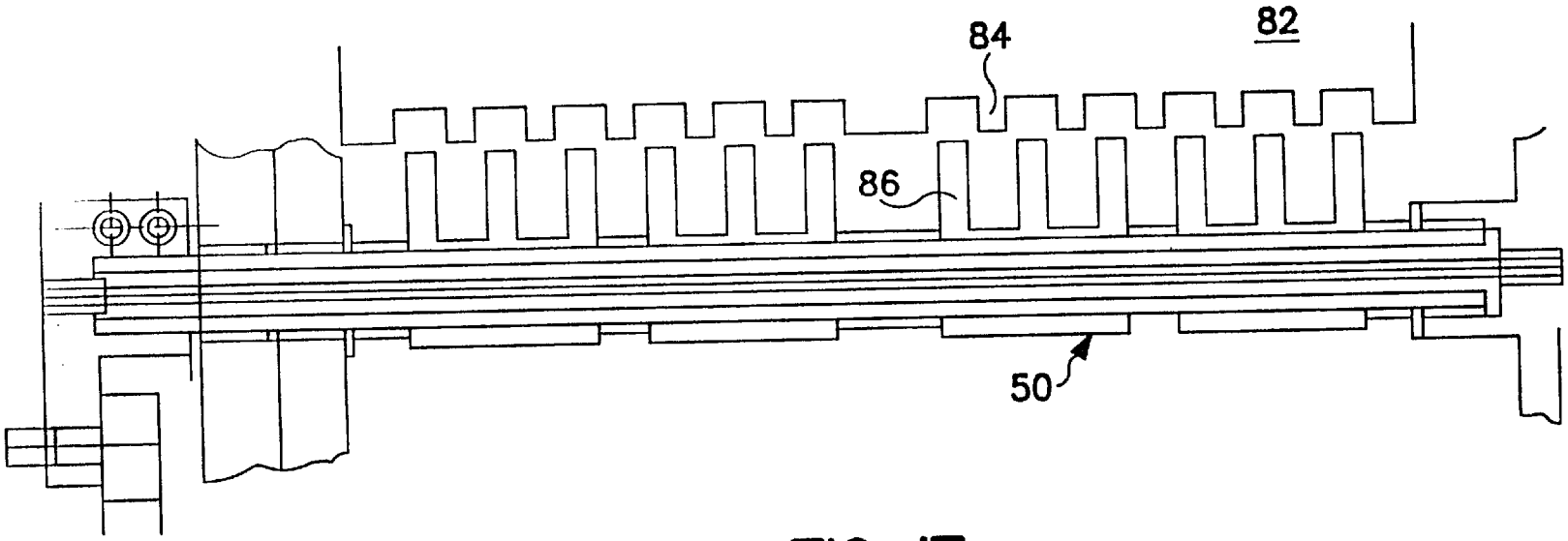
FIG. 17 is a front view of a gripper and tongue of a tucker roll showing tucker fingers in operative relation to gripper fingers.

FIG. 17 shows an alternate embodiment of tongue 82 which may include a plurality of longitudinally spaced tucker fingers 84 extending radially from tongue 82. When tucker fingers 84 are provided on tongue 82, fixed and movable portions 52 and 54 (illustrated in FIG. 14) each include a plurality of longitudinally spaced gripper fingers 86. Gripper fingers 86 of fixed portion 52 are substantially aligned with gripper fingers 86 of movable portion 54, and gripper fingers 86 cooperate in an interposed relationship with tucker fingers 84 when tongue 82 is rotated into one of grippers 50. Tucker fingers 84 preferably fit into the spaces between gripper fingers 86 such that there is no contact between tongue 82 or tucker fingers 84 and gripper 50 even if machine 30 is run without web 32 between tucker roll 80 and drum 40.

Alternately, and as shown in FIG. 12, mechanical grippers 50 can be replaced by vacuum source 251 that holds portion 236 against drum 240. A port 245 is defined on drum outer surface 244. Port 245 is in fluid flow communication with vacuum source 251 such that vacuum source 251 draws air inwardly through port 245 to create a suction effect for releasably holding web 232 against drum 240.

Figure 3:
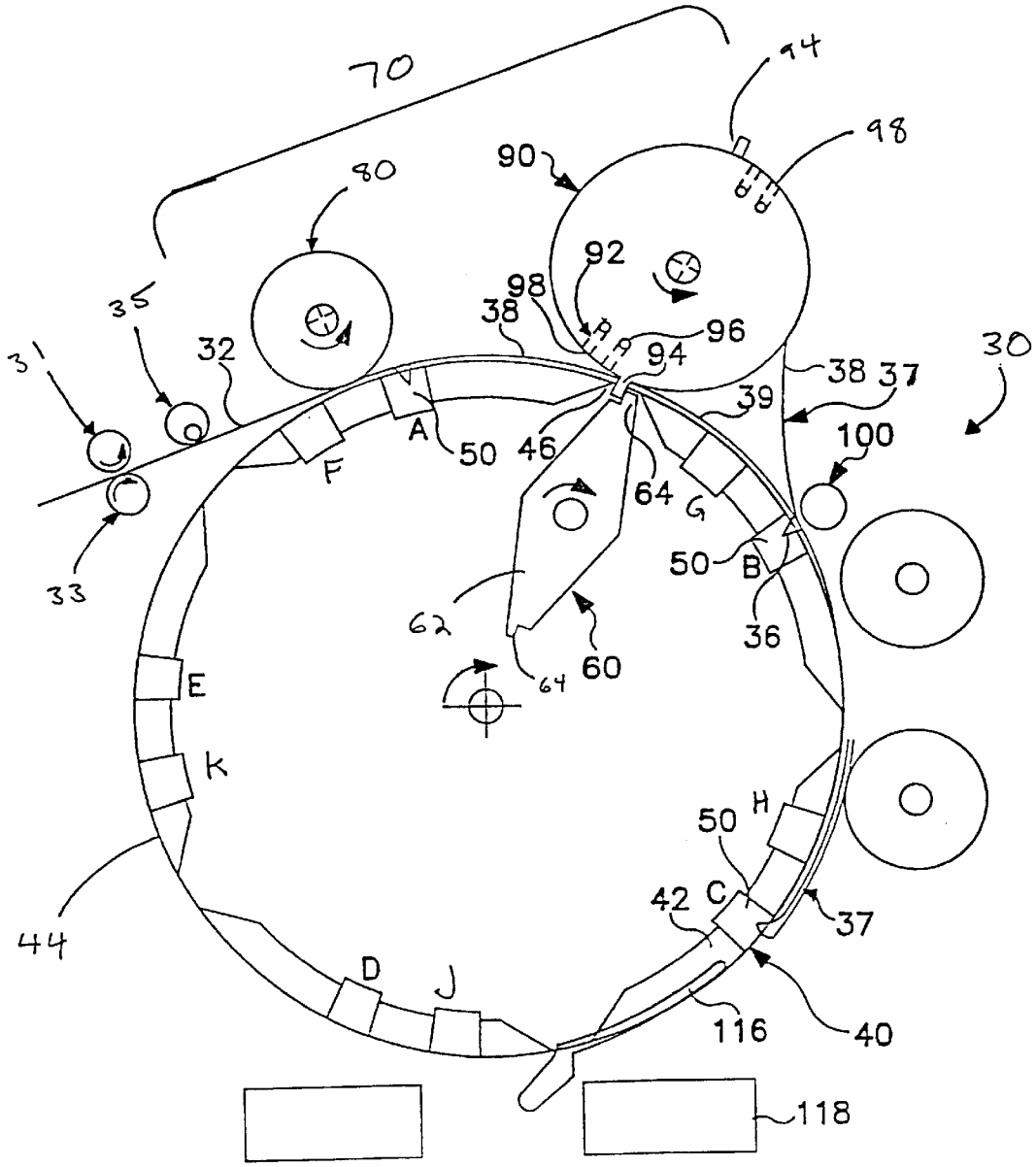
FIG. 3 is a simplified side elevation of the paper folding machine showing the web in relation to the drum and the folding station at a selected moment.

Referring now to FIGS. 1–3, folding roll 90 is provided at folding station 70 at a location "downstream" from tucker roll 80. Preferably, a retainer 92 is provided on folding roll 90 for releasably holding a leading edge 38 of section 34 of web 32. The leading edge 38 is preferably releasably held against folding roll 90 while drum 40 rotates to advance portion 36 of web 32 past folding roll 90. Folding roll 90 also rotates while holding leading edge 38 such that leading edge 38 is folded back over web 32. Once drum 40 rotates far enough to pull leading edge 38 away from folding roll 90, leading edge 38 is released from retainer 92 and folds back onto a trailing portion 39 of web 32 to create folded section 37, as illustrated in FIG. 3.

One will note that FIG. 1 also shows that folding roll 90 preferably includes at least one anvil 94 extending radially outwardly from folding roll 90 for cooperating with knife 60 to cut web 32. Alternately, blade 64 and anvil 94 can be interchanged, whereby body 62 includes at least one anvil instead of a blade, and folding roll 90 includes blade 64 in place of anvil 94.

Looking to FIG. 3 again, a vacuum source 96 is preferably provided as the retainer 92. Vacuum source 96 is in fluid-flow communication with ports 98 defined by folding roll 90. A suction effect is created when vacuum source 96 draws air through ports 98. Ports 98 are preferably defined adjacent to anvils 94 such that shortly after web 32 is cut by anvil 94 and knife 60 to create leading edge 38, the suction effect operates to releasably hold leading edge 38 against the surface of folding roll 90.

In an alternate embodiment illustrated in FIG. 12, , pressurized air ports 266 can be located on drum 240 just opposite vacuum ports 298 of folding roll 290. The air ports 266 can provide a stream of pressurized air from beneath leading edge 238 to lift leading edge 238 off of drum 240 to assist vacuum source 296 in holding leading edge 238 against vacuum port 298.

Figure 4:
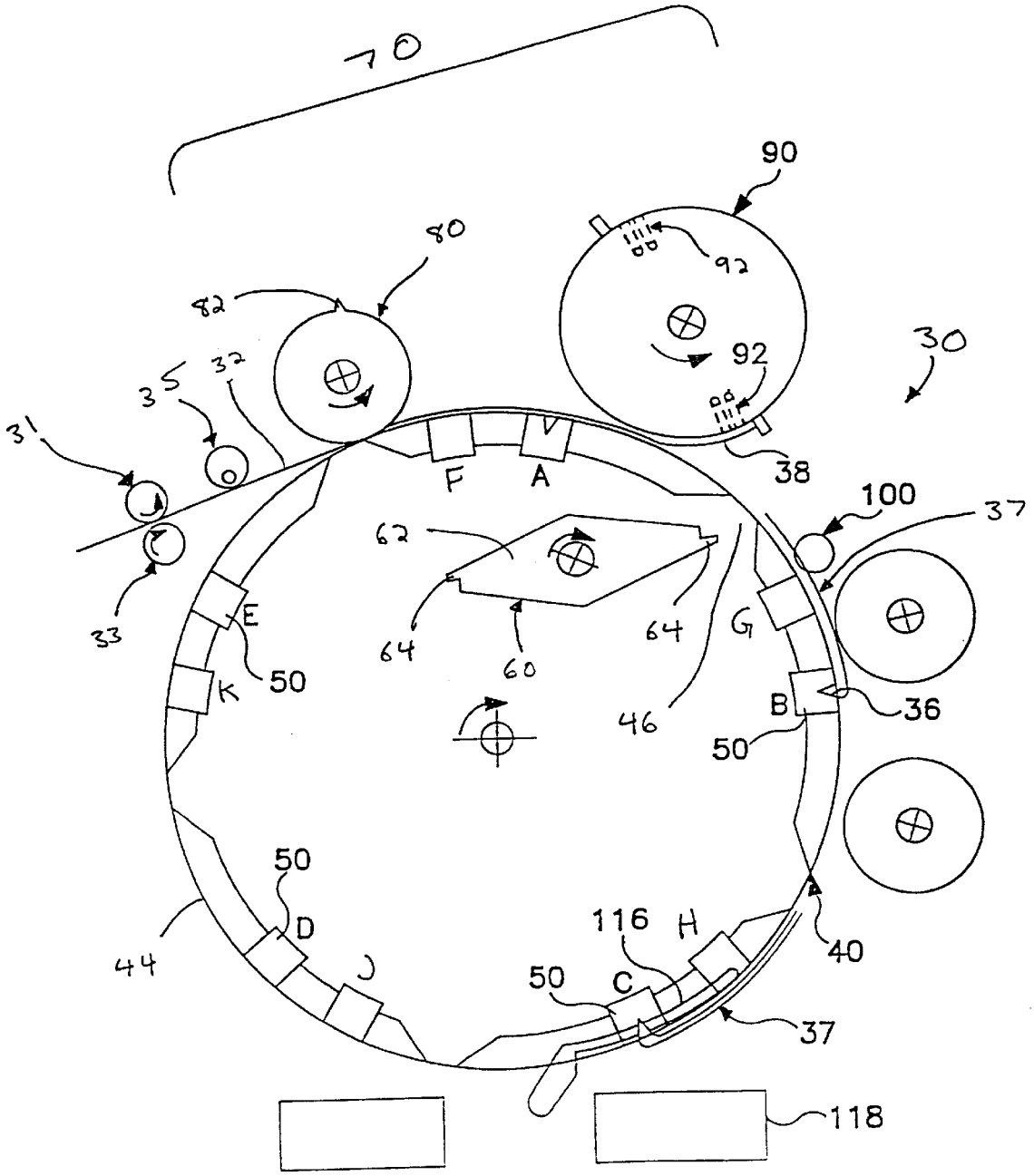
FIG. 4 is a simplified side elevation of the paper folding machine showing the web in relation to the drum and the folding station at a selected moment.
Figure 5:
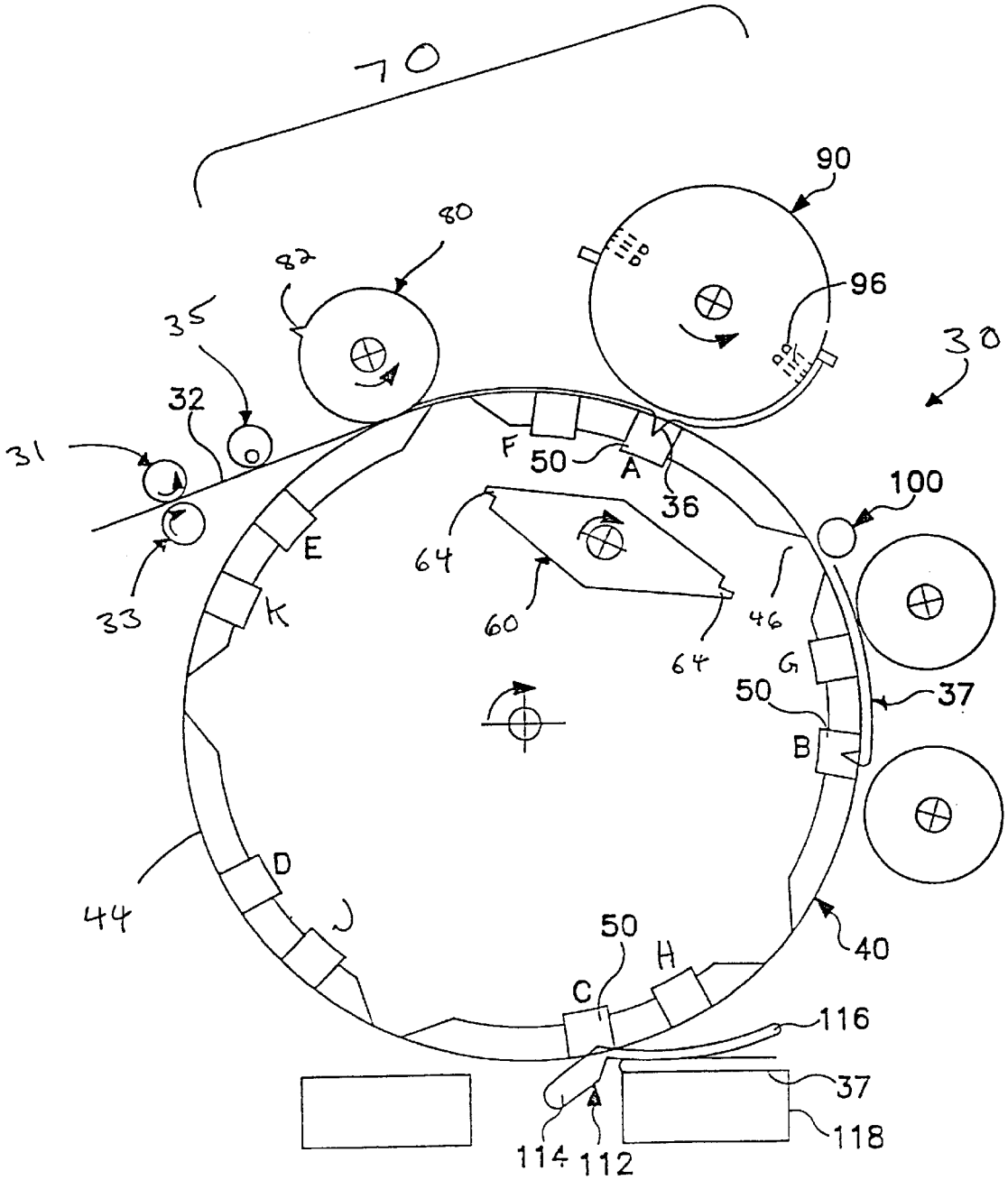
FIG. 5 is a simplified side elevation of the paper folding machine showing the web in relation to the drum and the folding station at a selected moment.

Referring again to FIGS. 1–11, folding station 70 also preferably includes ironing roll 100 at a location "downstream" from folding roll 90, i.e., circumferentially positioned relative to drum 40 in a spaced relationship with folding roll 90. Ironing roll 100 is a solid cylindrical roll that is adjacent to drum outer surface 44 and substantially para-axial with drum 40 and is biased against drum 40. As drum 40 rotates to move folded section 37 past ironing roll 100, the biasing force holds ironing roll 100 against drum 40 and ironing roll 100 presses folded section 37 as folded section 37 passes between ironing roll 100 and drum 40 after leading edge 38 has been folded back over trailing edge 39 to form folded section 37. Folded section 37 is removed from machine 30 and can be delivered in separate stacks of selectable variable count by pack-off station 110, as illustrated in FIG. 5.

FIG. 2 shows several folded sections 37 stacked into stacking receptacle 118 of packing station 110. Looking to FIGS. 2 & 5, pack-off station 110 includes a packing arm 112 having a pivoting body 114 and a pack-off finger 116. Pack-off finger 116 extends from pivoting body 114 and has a curvature that is generally similar to the curvature of drum 40. Pack-off finger 116 extends from pivoting body 114 in the direction opposite the rotation of drum 40. Peripheral ring 42 defines a groove 43 (FIG. 19) on drum outer surface 44 into which pack-off finger 116 is nested while it awaits the next folded section 37 to be carried by drum 40 to a position over pack-off finger 116, as shown in FIG. 4. When folded section 37 reaches the approximate position (location "C") shown in FIG. 4, gripper 50 releases folded section 37 and packing arm 112 pivots away from drum 40, carrying with it folded section 37, and guides folded section 37 into stacking receptacle 118, as shown in FIG. 5.

Figure 7:
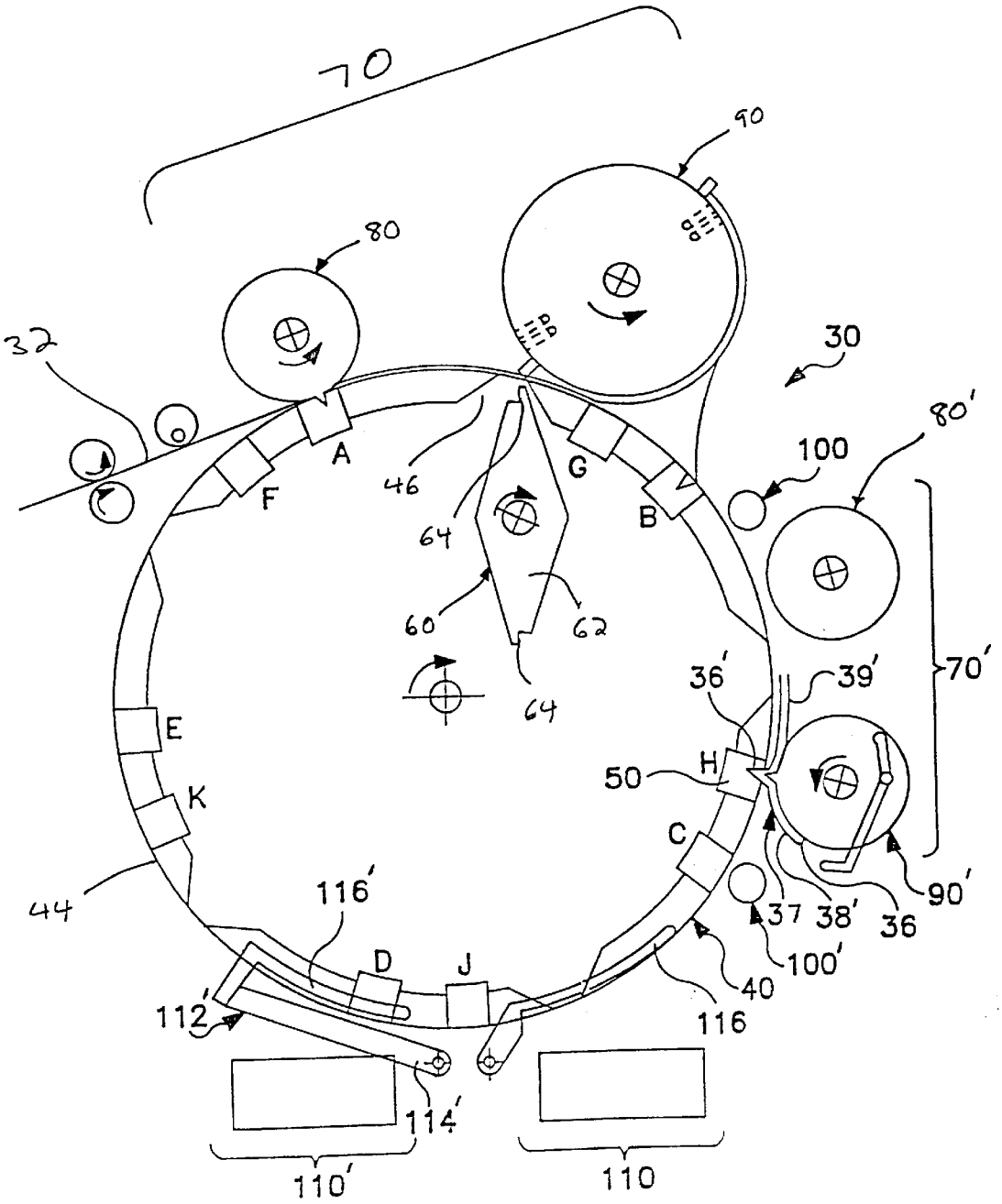
FIG. 7 is a simplified side elevation of the paper folding machine showing the web in relation to the drum and the folding station at a selected moment.
Figure 8:
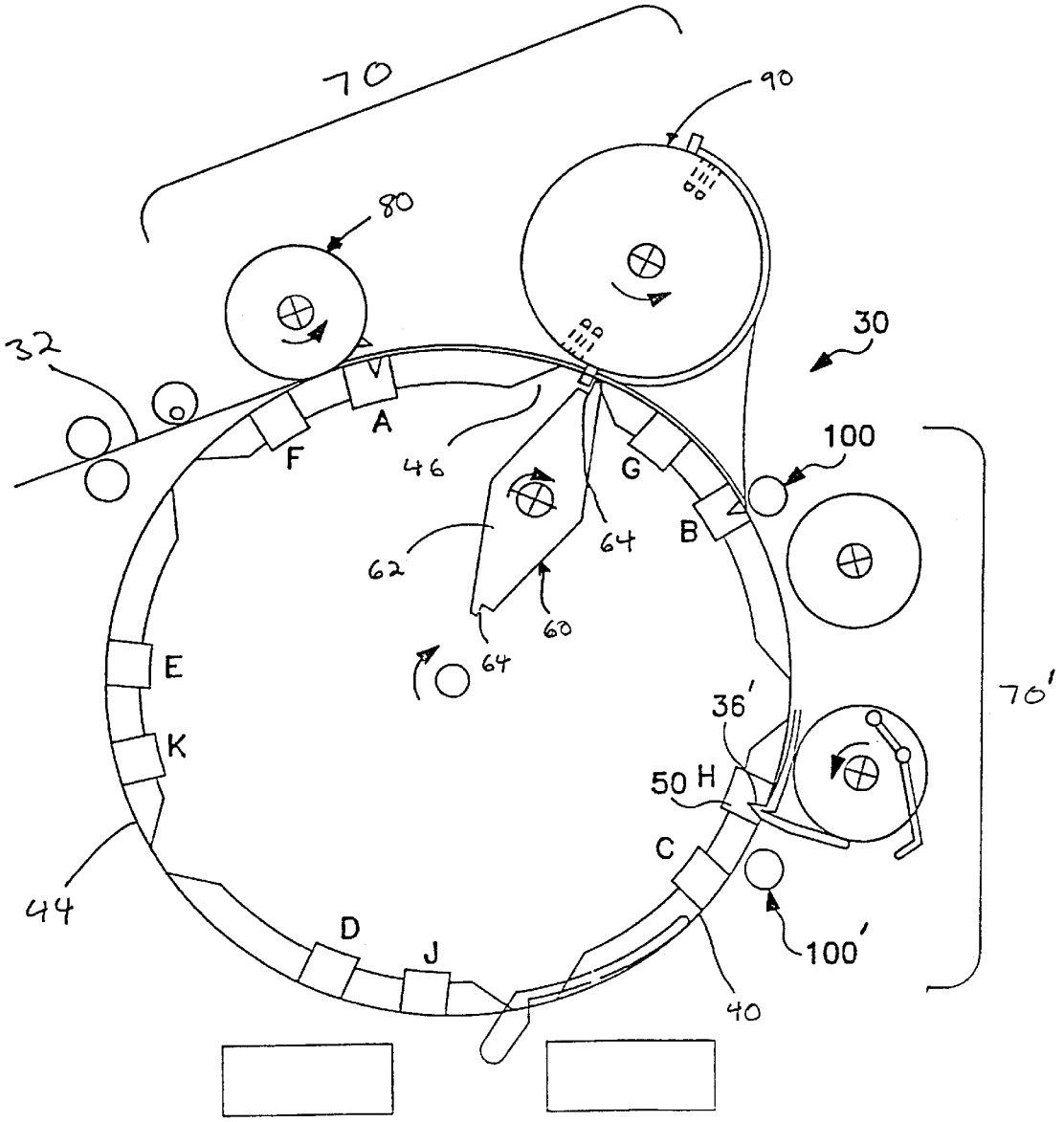
FIG. 8 is a simplified side elevation of the paper folding machine showing the web in relation to the drum and the folding station at a selected moment.

FIG. 7 illustrates machine 30 including a second pack-off station 110' "downstream" of the previously described station. The pivot direction of the second packing arm 112' is opposite that of the first, but the function of the finger 116' is similar. Pivoting body 114' extends in the general direction of rotation of drum 40, which necessitates the reversed pivot direction with respect to the "upstream" pivoting body 114.

Alternately, folded sections 37 or double-folded sections 37' can be removed from drum 40 by belts or other rotary devices.

Figure 18:
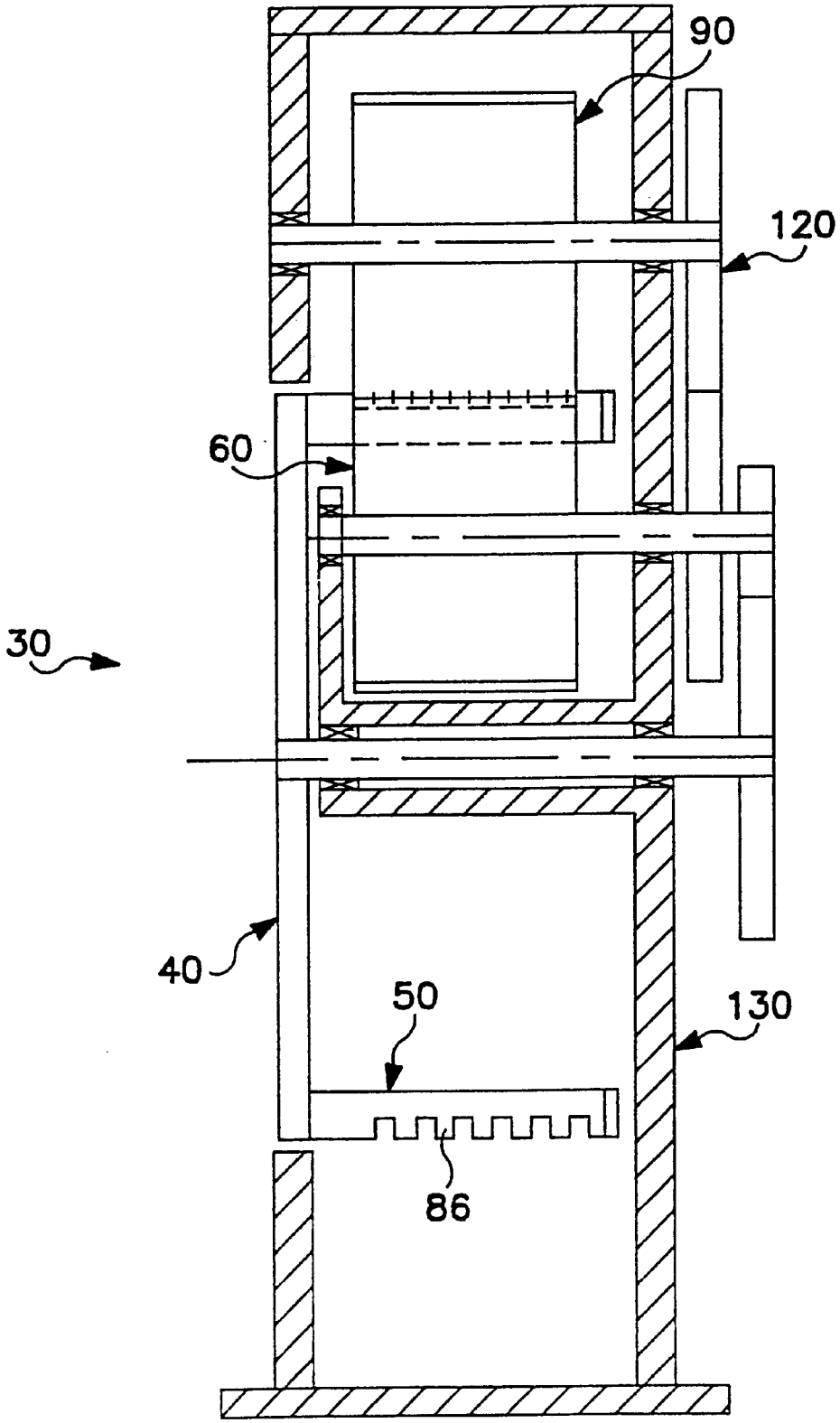
FIG. 18 is a cross-sectional front view of the paper folding machine of FIG. 16 taken along line 18—18 of FIG. 16.

FIG. 18 shows machine 30 supported in frame 130 as well as the inter-relationship of drum 40, knife 60, and folding roll 90, and coacting drive gears 120. The synchronization of drum 40, knife 60, and folding roll 90 can be accomplished by drive gears 120 or any suitable drive mechanism such as belts or chains. The relative diameters of the drum and rolls and the locations of the apertures, knife blades, tongues, and the like on the peripheries of their respective rolls are selected to achieve the appropriate synchronization of all the components.

A detailed description of the folding process is provided below in order to further illustrate the paper folding machine 30. FIGS. 2–6 illustrate the steps performed during the ¼ fold process, and FIGS. 7–11 illustrate the steps required during the ⅛ fold process. Each of FIGS. 1–11 is a "snapshot" of machine 30 at various selected points in time as all the parts are moving and rotating.

Referring to FIGS. 2–6, a ¼ fold process is illustrated wherein drum 40 cooperates with folding station 70 to provide a single initial fold in the web 32. A ¼ fold is achieved by feeding web 32 into machine 30 after web 32 has been folded in half lengthwise. A lengthwise fold need not be provided, however. For purposes of illustration herein, the initial fold of web 32 is hereafter referred to as the "¼ fold," regardless of whether or not web 32 has been pre-folded lengthwise.

To provide a complete description, the mechanism by which web 32 is fed into machine 30 is described but forms no part of the claimed invention. Pull rolls 31 and 33 are provided for pulling web 32 from a source (not shown). Pull rolls 31 and 33 are adjacent to each other and para-axial with drum 40. Pull rolls 31 and 33 are biased against each other, and web 32 is fed between pull rolls 31 and 33. Additionally, an optional eccentric feed roll 35 may be provided between pull rolls 31 and 33 and machine 30. Eccentric feed roll 35 may be provided to control the rate of feed in order to avoid over tension or under tension of web 32 as it is fed into machine 30. Eccentric feed roll 35 is biased against web 32 and is also para-axial with drum 40. Eccentric feed roll 35 rotates about an offset axis, and its rate of rotation and diameter are selected to cooperate with web 32 such that the tension in web 32 between feed rolls 31 and 33 and drum 40 is generally kept constant.

FIG. 2 illustrates machine 30 at a point in the process of forming the ¼ fold. As shown in FIG. 2, web 32 is tucked and gripped at the ¼ fold tucker roll 80 and gripper "A."

Tucker roll 80 is shown at a position where tongue 82 is aligned with gripper 50, at which point portion 36 of web 32 is urged into gripper 50. Letters A–E are provided for illustrative purposes in order to distinguish between grippers 50 of the illustrated embodiment. For clarity, web segments gripped at locations A, B, C, D & E will be designated as web portion 36 while web segments gripped at locations F, G, H, J & K will be designated at web portion 36'.

Knife 60 is shown at a position that is close to cutting web 32 at aperture 46. Leading edge 38 is shown while being releasably held against folding roll 90. The portion 36 shown gripped in gripper "B" is moving toward ironing roll 100. Portion 36 gripped at gripper "C" is shown after being flattened by ironing roll 100 and moving toward pack-off station 110. Pack-off finger 116 is shown positioned into drum 40 while waiting for folded section 37, which is gripped in gripper "C", to be rotated into a position adjacent to pack-off finger 116. Folded sections 37 that were previously gripped by grippers "D" and "E" are shown stacked in stacking receptacle 118.

FIG. 3 illustrates another snapshot of the process wherein drum 40 has been rotated slightly further than drum 40 shown in FIG. 2. In FIG. 3, web 32 is gripped at both grippers 50 located at positions "A" and "B." Knife 60 is shown in a position wherein blade 64 is aligned with aperture 46 and anvil 94 of folding roll 90. At this point, section 34 is created by cutting web 32. Leading edge 38 of section 34 is shown folded back over trailing portion 39 of section 34 to create folded section 37. Another leading edge 38 is created behind aperture 46 when 32 is cut.

Retainer 92 in folding roll 90 can preferably be a vacuum source located adjacent to anvil 94 and communicating with port 98. After web 32 is cut at aperture 46, vacuum source 96 is turned on to provide suction which draws leading edge 38 behind aperture 46 toward roll 90. The vacuum source 96 really simply holds leading edge 38 while drum 40 and folding roll 90 continue to rotate. Portion 36 gripped by gripper 50 at location "B" is shown in FIG. 3 at a point where it is being pressed by ironing roll 100. Pack-off finger 116 is shown in position within ring 42 while waiting for folded section 37 which is gripped by gripper 50 at location "C" to move into position adjacent to pack-off finger 116. Folded sections 37 that were previously gripped by grippers 50 at locations "D" and "E" have been placed into stacking receptacle 118.

FIG. 4 illustrates another snapshot of the machine 30 as drum 40 continues to rotate. Leading edge 38 is shown being held against folding roll 90 by retainer 92. Portion 36 being gripped by gripper 50 at location "B" has been folded tight by passing under ironing roll 100. Pack-off finger 116 is starting to move away from drum 40 to place folded section 37, which is being gripped by gripper 50 at location "C", into stacking receptacle 118. Folded sections 37 that were previously gripped by grippers 50 at locations D and E have been placed into stacking receptacle 118.

FIG. 5 illustrates yet another snapshot of the process of folding web 32 whereby drum 40 has rotated beyond the point illustrated in FIG. 4. Vacuum source 96 in folding roll 90 can be turned off at this point, while portion 36 of web 32 that is gripped by gripper 50 at location "A" continues to move toward ironing roll 100. Folded section 37 that is shown being gripped by gripper 50 at location B has been pressed by ironing roll 100. Pack-off finger 116 is shown in a position away from drum 40 whereby pack-off finger 116 has removed folded section 37 from gripper 50 at location "C" and moved folded section 37 into stacking receptacle 118. Folded sections 37 that were previously gripped by grippers 50 at locations D and E have been previously removed from those grippers and stacked into stacking receptacle 118.

Figure 6:
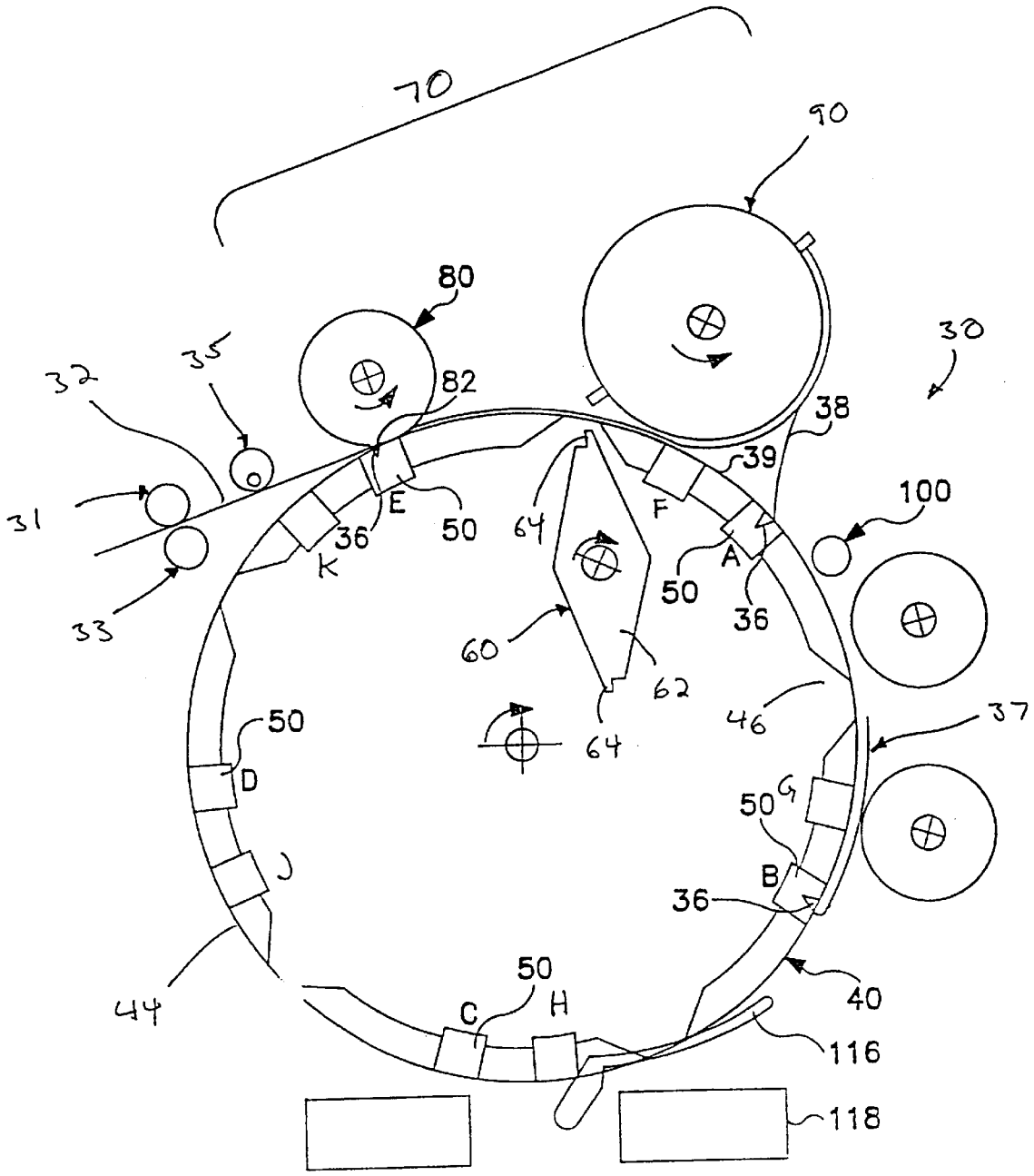
FIG. 6 is a simplified side elevation of the paper folding machine showing the web in relation to the drum and the folding station at a selected moment.

FIG. 6 illustrates yet another snapshot of machine 30 at a point where drum 40 as rotated past the point illustrated in FIG. 5. In FIG. 6, portion 36 is shown at a position where it is starting to be urged into gripper 50 at location E by tongue 82 of tucker roll 80. Leading edge 38 is shown in a position while being folded back over onto trailing edge 39 associated with portion 36 being gripped by gripper 50 at location "A". Portion 36 at location A is moving toward ironing roll 100. Folded section 37 associated with portion 36 being gripped by gripper 50 at location B is shown after it has passed under ironing roll 100 and has been pressed flat. Pack-off finger 116 is shown moving back into drum 40. Folded sections 37 that were previously gripped by grippers 50 at locations "C and "D" have been previously placed into stacking receptacle 118.

If desired, a subsequent fold can be accomplished in folded section 37 to create double-folded section 37' by providing a subsequent folding station 70' further around the circumference of drum 40 as shown in FIGS. 7–11. FIG. 7 also illustrates an alternate pack-off station 110'. In an alternate embodiment, dual pack-off stations 110 & 110' can be provided as illustrated in FIG. 7 to provide separate stacks of variable count. When two pack-off stations are provided, they can be alternately used such that when pack-off finger 116 that is located immediately after subsequent folding station 70' is positioned away from drum 40, a folded section 37 or double-folded section 37' can continue past the first pack-off finger 116 and on towards the second pack-off finger 116' that is awaiting within drum 40.

In FIG. 7, portion 36' being gripped by gripper 50 at location "H" is shown at a position while folded leading edge 38' associated with position "H" is being folded back over trailing portion 39' associated with position "H". Folded section 37 associated with position "H" has been ¼ folded and is now undergoing subsequent fold at folding station 70 to create double-folded section 37'. This subsequent fold is referred to as the ⅛ fold. Folding station 70' of FIG. 7 illustrates a folding roll 90' having a folding arm 91 for removing a portion 36 from a gripper 50 and for folding folded section 37 back over itself to provide an ⅛ fold. Folding roll 90' having folding arm 91 is illustrated in FIG. 19.

Folding arm 91 removes portion 36 from gripper 50 and releasably holds portion 36 against folding roll 90'. Folding arm 91 comprises a middle section 93 and first and second legs 95 and 97 extending from each end of middle section 93 and forming first and second bends 99 and 101 at the first and second ends, respectively. First leg 95 is pivotally attached to folding roll 90 at a pivot point 103 situated at an end of first leg 95 opposite the first bend 99. Pivot point 103 is offset from the axis of folding roll 90'. Folding arm 91 further includes a cam roller 105 at the first bend 99. Folding roll surrounds a fixed cam 106 having a profile 107 and which defines a slot 108 along the profile 107 for guiding cam roller 105 as folding roll 90' rotates around fixed cam 106 and moves cam roller 105 around the profile.

Figure 19:
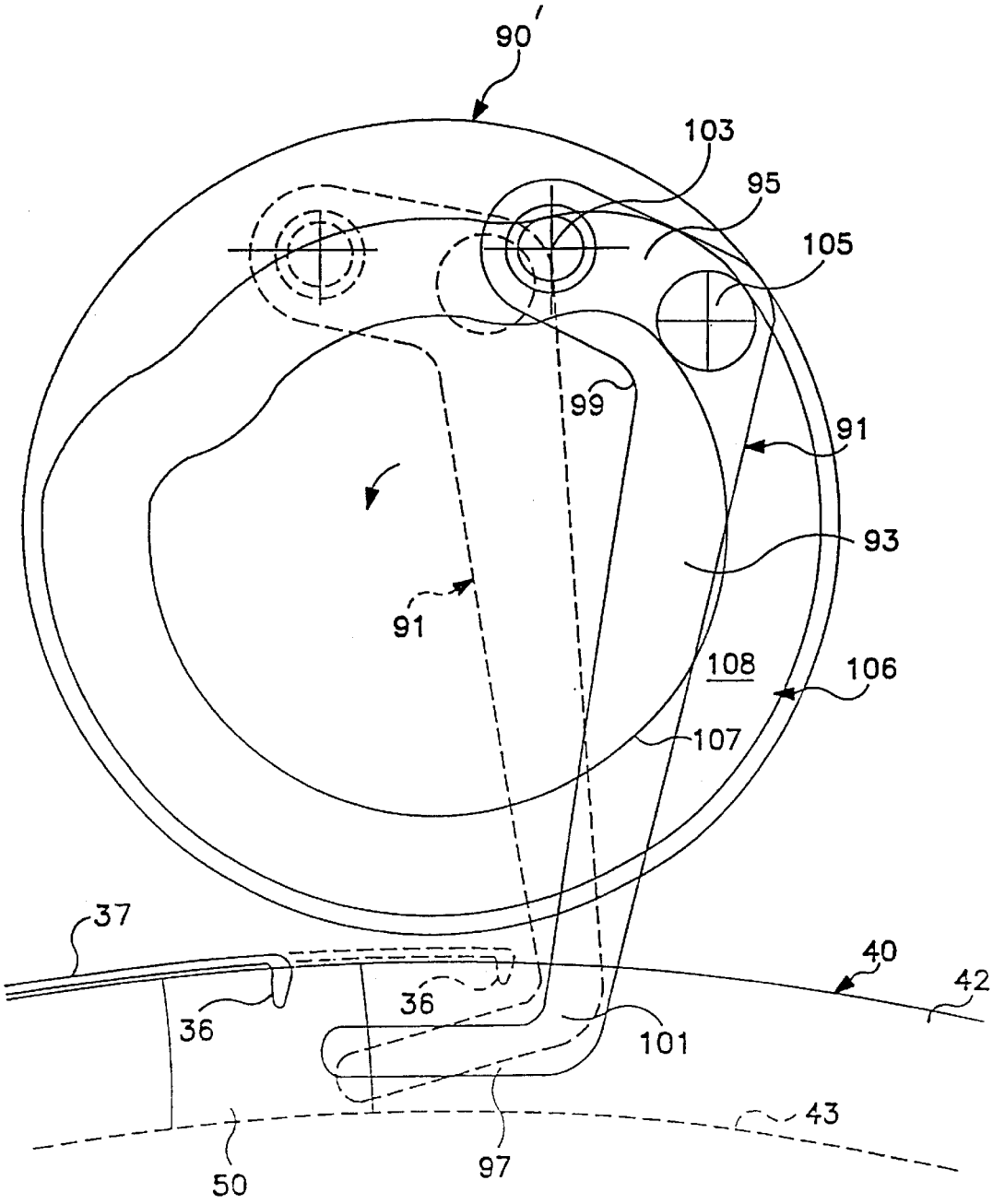
FIG. 19 is a enlarged simplified side elevation of a folding roll showing a folding arm in position to accept a gripped portion of a section of the web and an alternate position of the folding arm and the gripped portion.

As shown in FIG. 19, peripheral ring 42 defines a groove 43 for accepting second leg 97 of folding arm 91 when pivot point 103 and cam roller 105 are positioned relative to profile 107 of fixed cam 106 such that second leg 97 is generally tangent to and within the periphery of peripheral ring 42. With folding arm 91 in this position, portion 36 is moved into second bend 101 as cam roller 105 continues to travel over profile 107 and folding roll 90' rotates such that folding arm 91 moves second leg 97 out of groove 43 and second leg 97 pulls portion 36 out of gripper 50 and holds portion 36 against folding roll 90' as folded section 37 travels past folding roll 90'.

Referring again to FIG. 8, portion 36 being gripped by gripper 50 at position "H" is moving toward ironing roll 100' for a subsequent ironing step.

Figure 9:
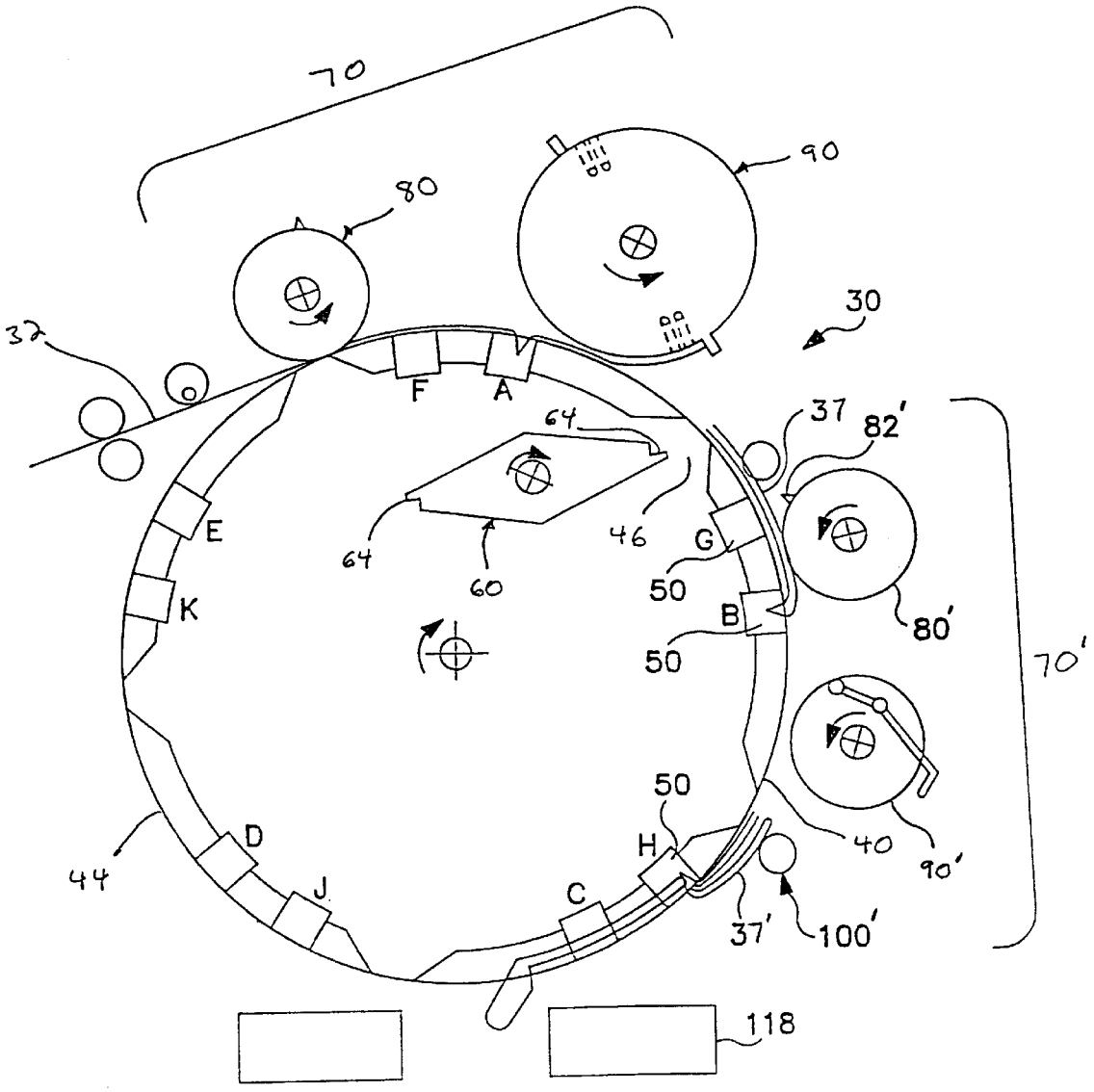
FIG. 9 is a simplified side elevation of the paper folding machine showing the web in relation to the drum and the folding station at a selected moment.

In FIG. 9, folded section 37 associated with gripper 50 at location "B" is shown at a position where it is about to be urged into gripper 50 at position "G" by tongue 82' on tucker roll 80'. Double-folded section 37' associated with gripper 50 at location H is shown passing under ironing roll 100' after having been through the ⅛ fold step. Double-folded sections 37' that were previously gripped by grippers 50 at locations J and K and that had undergone the ⅛ fold step have been removed from grippers 50 at locations J and K and placed into stacking receptacle 118.

In FIG. 10, folded section 37 associated with gripper 50 at location B is shown in a position where portion 36' has just been urged into gripper 50 at location "G" by tongue 82' on tucker roll 80'. As gripper 50 at location B reaches folding roll 90', to undergo the ⅛ fold, gripper 50 at location B will open via the cam mechanism to allow portion 36 associated with location B to be removed from gripper 50 at location B by folding arm 91 of folding roll 90'. Double-folded section 37' associated with gripper 50 at location "H" (⅛ folded) has passed under ironing roll 100'. Double-folded section 37' associated with location "H" has moved into position adjacent packing finger 116 whereby it is ready to be removed from drum 40 and stacked into stacking receptacle 118 by packing arm 112.

Figure 11:
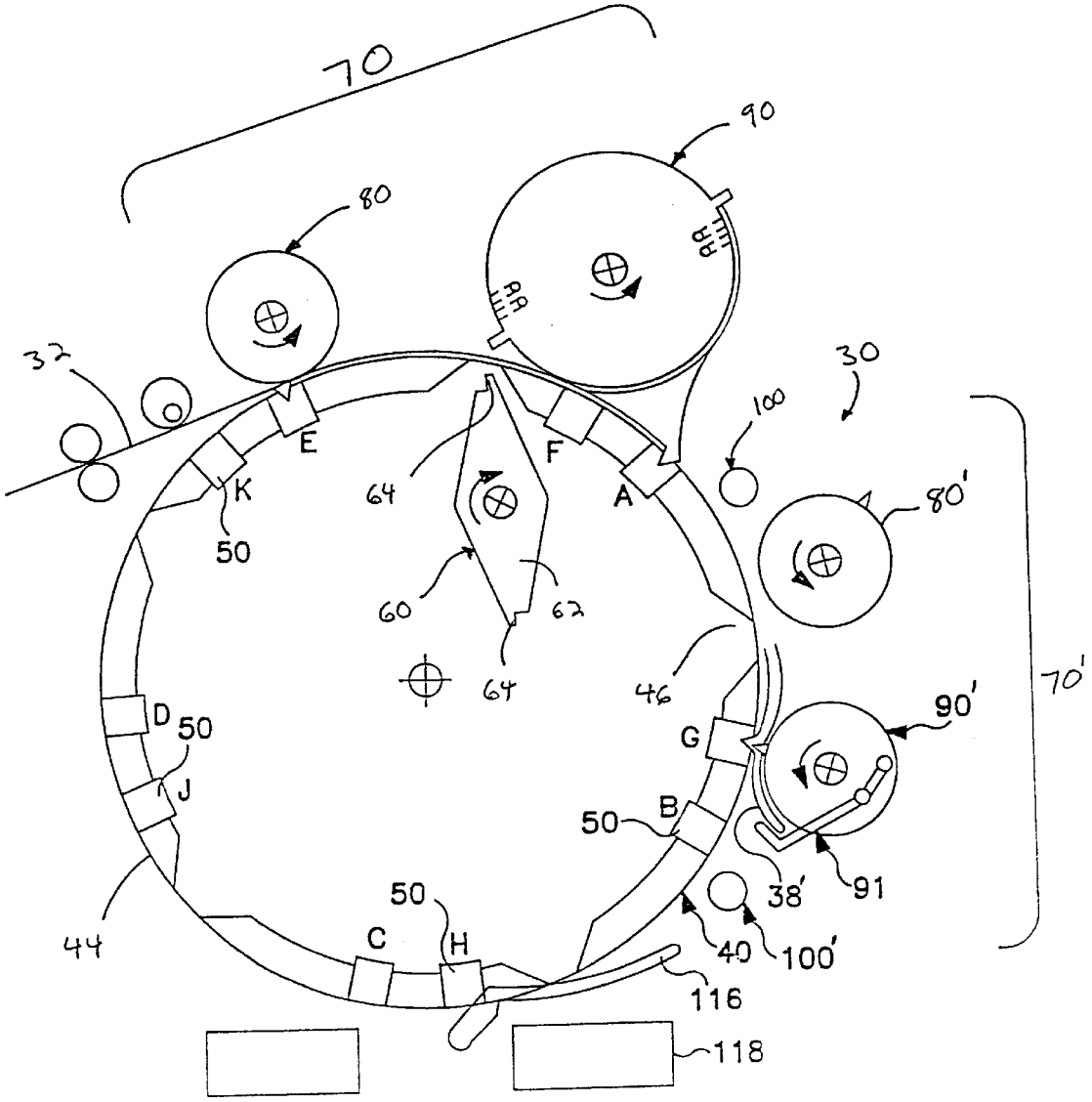
FIG. 11 is a simplified side elevation of the paper folding machine showing the web in relation to the drum and the folding station at a selected moment.

In FIG. 11, folding roll 90' has removed folded leading edge 38' from gripper 50 of location B and is holding folded leading edge 38' against folding roll 90 with folding arm 91. Pack-off finger 116 is shown moving back toward drum 40 after having removed double-folded section 37' from gripper 50 of location "H" and placed it into stacking receptacle 118. Double-folded sections 37' previously associated with grippers 50 at locations "J" and "K" have been removed and stacked into stacking receptacle 118.

The foregoing description and the accompanying drawings are illustrative of the present invention. Still other variations and arrangements of parts are possible without departing from the spirit and scope of this invention.

We claim:

1. A paper folding machine for severing a continuously fed web of paper into sections and folding said sections, the machine comprising:

a rotating hollow drum which includes a peripheral ring defining a drum outer surface and a drum interior, the outer surface having both a plurality of grippers extending around the periphery of the rotating hollow drum in spaced apart relationship and adapted to hold the web of paper therebetween against the drum outer surface and a plurality of apertures extending around the periphery of the outer surface of the rotating hollow drum in spaced apart relationship, the apertures being located between respective grippers and communicating with said drum interior;

a knife located in the interior of the drum and rotatable in synchronism with the rotating drum about an axis offset from and parallel to the axis of rotation for the drum to extend radially outwardly through said respective apertures as the drum rotates for severing said web while said web is situated on said drum outer surface and is being held by the grippers; and at least one folding station at the periphery of the rotating drum for severing and folding said web while on the rotating drum, the folding station including a folding roll adjacent to said drum outer surface and substantially para-axial with said drum, the folding roll including at least one anvil for interaction with said knife through the aperture of said drum while said web is situated on said drum outer surface, and at least one retainer adjacent to and following said anvil, the retainer releasably holding a leading edge of said web to be folded back over said web while said drum rotates and said portion of said web gripped by one of said grippers moves past the folding roll thereby providing a fold in the web, and the folding roll being driven in synchronism with the rotating drum being rotated in a direction opposite that of the rotating drum.

2. The paper folding machine of claim 1 wherein each of said grippers is located adjacent to each of said apertures.

3. The paper folding machine of claim 1 further comprising a pressurized air source on said drum and wherein said peripheral ring defines a plurality of air ports in fluid flow communication with said pressurized air source, each said air port situated on said peripheral ring adjacent to and immediately following each said aperture and corresponding with said retainer of said folding roll as said drum and folding roll rotate, whereby the pressurized air source provides a stream of air through the air port for lifting said section of said web off of said drum and holding said section against said retainer of said folding roll.

4. A paper folding machine for severing a continuously fed web of paper into sections and folding said sections, the machine comprising:

(a) a rotating hollow drum which includes a peripheral ring defining a drum outer surface and at least one knife aperture communicating with the drum interior, a rotatable knife for severing said web, the knife being situated within the drum interior and rotatable about an axis offset from and parallel to the axis of rotation for the drum and grippers on the drum outer surface spaced from one another and adapted to grip and hold the web of paper against the drum outer surface, the aperture being situated between adjacent grippers and a portion of the knife being adapted to extend through the aperture in synchronism with the rotating drum for severing the web of paper being held between the adjacent grippers;

(b) at least one folding station at the periphery of said rotating drum for folding said web while on said rotating drum, the folding station including a tucker roll and a folding roll, each said roll being adjacent to said drum outer surface and substantially para-axial with said drum;

the tucker roll including a tongue that extends radially outwardly from the tucker roll for urging a segment of said web into one of said grippers whereby said segment is gripped by said gripper, said segment in said gripper defining a leading portion of said web and a trailing portion of said web, said grippers being actuated in synchronism with the tucker roll to grip said segment;

the folding roll having an outer surface and including a retainer for releasably holding a leading edge of said web to be folded back over said trailing portion of said web while said drum rotates and said segment of said web gripped by one of said grippers moves past the folding roll thereby providing a fold in the web, said trailing portion of said web remaining on the outer surface of said rotating hollow drum; and said tucker roll and said folding roll being driven in synchronism with said rotating drum but being rotated in a direction opposite that of said rotating drum.

5. The paper folding machine of claim 4 wherein said web is gripped by two of said grippers while said web is cut.

6. The paper folding machine of claim 4 wherein said knife comprises a body rotatable within the drum interior and having at least one blade extending radially outwardly therefrom and extendable through said aperture in synchronism with the rotating drum for severing the web of paper, the rotatable body extending longitudinally and generally para-axially with said drum, the axis of the rotatable body being fixed in relation to said rotating drum.

7. The paper folding machine of claim 4 wherein each of said grippers includes a fixed portion cooperating with a movable portion to grip said segment of said web urged into said gripper by said tongue, the fixed portion including an elongated fixed face extending longitudinally along said drum, the movable portion including an elongated movable face normally biased against said fixed face, said grippers holding said web against the outer surface of the hollow drum while said web is both severed by said knife and folded by said folding roll.

8. The paper folding machine of claim 4 wherein said folding station both severs said web and provides an initial fold in said web while said grippers hold said web against the outer surface of the hollow drum, the folding station folding said leading portion of said web back over said trailing portion of said web while said trailing portion of said web remains on the outer surface of said rotating hollow drum.

9. The paper folding machine of claim 8 wherein said folding roll further includes at least one anvil that extends radially outwardly from said folding roll, the anvil having a portion adapted to extend through the aperture of said rotating hollow drum for cooperating with said knife to cut said web.

10. The paper folding machine of claim 9 wherein said retainer comprises a vacuum source within said folding roll and said folding roll defines at least one port in fluid flow communication with the vacuum source whereby the vacuum source draws air through the port to create a suction effect for releasably holding said leading edge of said web against said folding roll, the port adjacent to and immediately following said anvil.

11. The paper folding machine of claim 4 wherein said folding station provides a subsequent fold in said web while said trailing portion of said web remains on the outer surface of said rotating hollow drum, said subsequent fold defining a subsequent leading portion.

12. The paper folding machine of claim 11 wherein said folding roll further includes a folding arm for removing said subsequent leading portion of said web gripped by one of said grippers from said gripper and releasably holding said subsequent leading portion against said folding roll, the folding arm having an end positioned within a groove in the drum outer surface when removing said leading portion of said web, the groove in said drum outer surface defined by the peripheral ring.

13. The paper folding machine of claim 12 wherein said folding arm comprises a middle section and first and second legs extending from each end of the middle section and forming first and second bends at the first and second ends, respectively, the second leg positioned outwardly of the outer surface of the folding roll, the first leg pivotally attached to said folding roll at a pivot point situated at an end of the first leg opposite the first bend, the pivot point being both offset from the axis of said folding roll and diametrically positioned about said folding roll axis from said second leg, said folding arm further including a cam roller at the first bend, and said folding roll surrounding a fixed cam having a profile and defining a slot along the profile for guiding the cam roller as said folding roll rotates around the fixed cam and moves the cam roller around the profile.

14. The paper folding machine of claim 4 wherein said folding station further includes an ironing roll adjacent to said drum outer surface and substantially para-axial with said drum, the ironing roll being biased against said drum outer surface and circumferentially positioned relative to said drum in a spaced relationship with said folding roll for creasing a fold in said web between said drum and the ironing roll after said leading portion has been folded back over said trailing portion of said web while said folding drum rotates and said fold moves past the ironing roll, said trailing portion of said web remaining on the outer surface of said rotating hollow drum.

15. The paper folding machine of claim 4 further comprising a pack-off station, the pack-off station including a packing arm having a pivoting body and a pack-off finger having a curvature generally similar to the curvature of said drum extending from the pivoting body in a direction against the rotation of said drum, the pack-off finger being nested in a groove defined on said drum outer surface by said peripheral ring until said portion of said web being gripped moves over the pack-off finger and the packing arm subsequently rotates away from the groove whereby the portion of the web is removed from said drum.

16. A paper folding machine for cutting a continuously fed web of paper into sections and folding said sections, the machine comprising:

(a) a rotating hollow drum which includes a peripheral ring having a drum outer surface and defining at least one knife aperture communicating with the drum interior, a rotatable knife situated within the drum interior, and grippers on the drum outer surface spaced from one another, the aperture being situated between adjacent grippers and defining a fore and an aft gripper in relation to said aperture for gripping and holding the web of paper against the drum outer surface, the fore and aft grippers defining a set, and a portion of the knife being adapted to extend through the aperture in synchronism with the rotating drum for severing the web of paper being held between the adjacent grippers, the knife being rotatable about an axis offset from and parallel to the axis of rotation for the drum;

(b) a tucker roll adjacent to said drum outer surface and substantially para-axial with said drum, the tucker roll including a tongue that extends radially outwardly from the tucker roll for urging a segment of said web into said aft grippers, said segment in said aft gripper defining a leading portion of said web and a trailing portion of said web, said gripper being actuated in synchronism with the tucker roll to grip said segment;

(c) a folding roll adjacent to said drum outer surface and substantially para-axial with said drum, the folding roll including at least one anvil that extends radially outwardly from the folding roll, the anvil having a portion adapted to extend through the aperture of said rotating drum for cooperating with said knife to cut said web, thereby providing a leading edge of said leading portion when said knife, said knife aperture, and the anvil are radially aligned;

the tucker roll and the folding roll being driven in synchronism with the rotating drum but being rotated in a direction opposite that of the rotating drum; and (d) a retainer adjacent to and immediately following said anvil, the retainer releasably holding said leading edge of said web against said folding roll after said web is cut, such that said leading edge is folded back over said trailing portion of said web as said drum rotates and said portion of said trailing portion moves past said folding roll thereby providing an initial fold in the web, and forming an initially folded section.

17. The paper folding machine of claim 16 wherein said drum includes plural sets of grippers and corresponding knife apertures.

18. The paper folding machine of claim 16 wherein said drum includes five sets of grippers and five knife apertures.

19. The paper folding machine of claim 16 wherein said web is gripped by two of said grippers while said web is cut.

20. The paper folding machine of claim 16 wherein said knife comprises a body rotatable within the drum interior and having at least one cutting edge extending radially outwardly therefrom and extendable through said aperture in synchronism with the rotating drum for severing the web of paper, the rotatable body extending longitudinally and generally para-axially with said drum, the axis of the rotatable body fixed in relation to the rotating drum.

21. The paper folding machine of claim 20 wherein said knife comprises two blades in generally opposed positions on said rotatable body and extending longitudinally along said rotatable body.

22. The paper folding machine of claim 16 wherein said retainer comprises a vacuum generator within said folding roll and said folding roll defines at least one port in fluid flow communication with the vacuum generator, the port adjacent to and immediately following said anvil.

23. The paper folding machine of claim 22 wherein said folding roll includes two anvils in generally opposed positions on said folding roll and said folding roll defines two ports respectively adjacent to each of the two anvils such that said vacuum generator draws air through said ports to create a suction effect to releasably hold said leading edge of said web.

24. The paper folding machine of claim 16 further comprising a subsequent tucker roll and a subsequent folding roll for providing a subsequent fold in said web, said subsequent tucker roll for urging said web into said fore gripper.

25. The paper folding machine of claim 24 wherein said subsequent fold is provided by said subsequent folding roll which includes a folding arm for removing said portion from one of said fore grippers and releasably holding said portion against the folding roll until said portion moves past said folding roll; and wherein said folding arm comprises a middle section and first and second legs extending from each end of the middle section and forming first and second bends at the first and second ends, respectively, the second leg positioned outwardly of the outer surface of the folding roll, the first leg pivotally attached to said folding roll at a pivot point which is offset from the axis of said folding roll and spaced rotational from said second leg, said folding arm further including a cam roller at the first bend, and said folding roll surrounding a fixed cam having a profile and defining a slot along the profile for guiding the cam roller as said folding roll rotates around the fixed cam and moves the cam roller around the profile.

26. The paper folding machine of claim 16 further comprising at least one pack-off station adjacent to said drum for removing said folded section from said drum and stacking said folded section; said pack-off station being in synchronism with the rotating drum such that said folded section is removed when said drum rotates said folded section into general alignment with the pack-off station.

27. The paper folding machine of claim 26 wherein said pack-off station includes a packing arm having a pivoting body pivoting about a pivot point and a pack-off finger extending from the pivoting body in a direction against the rotation of said drum, the pack-off finger adapted to nest within a groove and having a curvature generally similar to the curvature of said drum, the pack-off finger being nested in said groove until said portion of said web being gripped moves over the pack-off finger and the packing arm subsequently rotates away from said groove such that said folded section is removed from said drum.

28. The paper folding machine of claim 26 wherein said pack-off station is disengageable.

29. A high speed method for cutting a continuously fed web of paper into sections and folding said sections comprising the steps of:

(a) depositing said web of paper onto a rotating hollow drum including at least two spaced apart grippers, an aperture formed in said rotating drum and located between the two spaced apart grippers, and a rotatable knife located in the drum and rotatable about an axis offset from and parallel to the axis of rotation for the drum;

(b) gripping said web of paper at two first tucked portions with two of a plurality of first grippers situated on said drum;

(c) extending the knife through the aperture in synchronism with the rotating hollow drum for cutting said web adjacent to and between the two first tucked portions while said web is being gripped thereby creating a leading edge on said web; and (d) folding said leading edge back over said web while on the rotating drum thereby creating a folded section;

and thereafter repeating steps (a) through (d) at least once during each revolution of said drum.

* * * * *